US012677905B2

(12) United States Patent
Healey et al.

(10) Patent No.: US 12,677,905 B2
(45) **Date of Patent: *Jul. 14, 2026**

(54) ARTICLE OF FOOTWEAR HAVING A SOLE STRUCTURE

(71) Applicant: PUMA SE, Herzogenaurach (DE)

(72) Inventors: Laura Healey, Boston, MA (US); Maximilian Gruettner, Nuremberg (DE); Mauro Bonin, Nuremberg (DE); Romain Girard, Lauf an der Pegnitz (DE); Jesus Marini Parissi, Milan (IT)

(73) Assignee: PUMA SE, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/098,476

(22) Filed: Apr. 2, 2025

(65) Prior Publication Data

US 2025/0380766 A1 Dec. 18, 2025

Related U.S. Application Data

(63) Continuation of application No. 18/741,011, filed on Jun. 12, 2024, now Pat. No. 12,550,971.

(51) Int. Cl.
*A43B 13/12* (2006.01)
*A43B 13/14* (2006.01)

(52) U.S. Cl.
CPC ..... *A43B 13/12* (2013.01); *A43B 13/122* (2013.01); *A43B 13/125* (2013.01); *A43B 13/143* (2013.01)

(58) Field of Classification Search
CPC ..... A43B 13/12; A43B 13/122; A43B 13/125; A43B 13/127; A43B 23/081
USPC ..... 36/77 R, 107, 30 R
See application file for complete search history.

(56) References Cited

U.S. PATENT DOCUMENTS 6,205,683 B1 * 3/2001 Clark ..... A43B 13/12 36/31
6,321,469 B1 * 11/2001 Cretinon ..... A43B 13/12 36/102
7,487,604 B2 * 2/2009 Perron, Jr. ..... A43B 5/02 36/108
9,532,623 B2 * 1/2017 Kilgore ..... A43B 13/14
10,314,367 B2 6/2019 Kilgore et al.
(Continued)

FOREIGN PATENT DOCUMENTS

EP 3355738 B1 8/2020

OTHER PUBLICATIONS

European Patent Office, Extended Search Report, Application No. 25177550.8, Nov. 5, 2025, 10 pages.

*Primary Examiner* — Marie D Bays
(74) *Attorney, Agent, or Firm* — Quarles & Brady LLP

(57) ABSTRACT

An article of footwear having an upper and a sole structure includes a top midsole coupled to the upper, a sole plate coupled to the top midsole, and a front midsole coupled to the top midsole. The sole plate is disposed between the toe end and the widest section of the sole structure. A rear midsole is coupled to the top midsole and the sole plate and disposed between the heel end and the narrowest section of the sole structure. An outsole is directly coupled to the front midsole and the rear midsole. A toe end of the outsole extends beyond a toe end of the front midsole, and the toe end of the front midsole extends beyond a toe end of the sole plate. The toe ends of the sole plate, the front midsole, and the outsole extend beyond a toe end of the top midsole.

21 Claims, 18 Drawing Sheets

(56) References Cited

U.S. PATENT DOCUMENTS

| | | | | |
|---|---|---|---|---|
| 12,349,760 | B2 * | 7/2025 | Frank | A43B 13/148 |
| 2005/0235527 | A1 * | 10/2005 | Perron | A43B 5/02 36/107 |
| 2010/0186257 | A1 * | 7/2010 | Karl | A43B 5/12 36/44 |
| 2017/0071286 | A1 * | 3/2017 | Kilgore | A43C 15/02 |
| 2017/0095034 | A1 * | 4/2017 | Dupre | A43B 7/148 |
| 2017/0265565 | A1 * | 9/2017 | Connell | A43B 13/206 |
| 2019/0313733 | A1 | 10/2019 | Bartel et al. | |
| 2020/0077740 | A1 * | 3/2020 | Chiu | A43B 13/187 |
| 2021/0204651 | A1 * | 7/2021 | Thompson | A43B 13/16 |
| 2022/0110405 | A1 * | 4/2022 | Megrabyan | A43B 7/1415 |
| 2022/0248804 | A1 | 8/2022 | Chang et al. | |
| 2023/0144343 | A1 * | 5/2023 | Dunning | A43B 23/08 36/88 |
| 2023/0172308 | A1 * | 6/2023 | Frank | A43B 13/127 36/25 R |
| 2023/0284739 | A1 * | 9/2023 | Hillyer | A43B 13/125 |
| 2024/0114998 | A1 | 4/2024 | Giandolini et al. | |
| 2024/0138518 | A1 * | 5/2024 | Kozuka | A43B 13/127 |
| 2024/0373980 | A1 * | 11/2024 | Andrews | A43B 13/122 |
| 2025/0127261 | A1 * | 4/2025 | Kajiwara | B33Y 10/00 |
| 2025/0288054 | A1 | 9/2025 | Frank et al. | |

* cited by examiner

ARTICLE OF FOOTWEAR HAVING A SOLE STRUCTURE

CROSS REFERENCE TO RELATED APPLICATIONS

This patent application is a continuation of U.S. patent application Ser. No. 18/741,011, filed Jun. 12, 2024, the entire contents of which is hereby incorporated by reference, for any and all purposes.

REFERENCE REGARDING FEDERALLY SPONSORED RESEARCH OR DEVELOPMENT

Not applicable

SEQUENCE LISTING

Not applicable

BACKGROUND

1. Field of Disclosure

The present disclosure relates generally to an article of footwear including a sole structure.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole attaches to a lower surface or boundary of the upper and positions itself between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

However, in many cases, articles of footwear having uppers with an increased comfort and better fit are desired, along with soles having improved cushioning systems or structural characteristics.

SUMMARY

An article of footwear having a sole structure and an upper, the sole structure comprising a widest section, a narrowest section, a toe end, a heel end, a lateral side, and a medial side. The sole structure further comprises a top midsole directly coupled to the upper, a sole plate directly coupled to the top midsole, a front midsole directly coupled to the top midsole and the sole plate between the toe end of the sole structure and the widest section of the sole structure, a rear midsole directly coupled to the top midsole and the sole plate between the heel end of the sole structure and the narrowest section of the sole structure; and an outsole defining a ground engaging surface and directly coupled to the front midsole and the rear midsole. The front midsole is spaced laterally forward from the rear midsole resulting in a void between the front midsole and the rear midsole, and an underside of the sole plate is exposed in the void between the front midsole and the rear midsole.

An article of footwear having a sole structure and an upper, the sole structure comprising a widest section, a narrowest section, a toe end, a heel end, a lateral side, and a medial side. The sole structure further comprises a top midsole directly coupled to the upper, a sole plate directly coupled to the top midsole, a front midsole directly coupled to the top midsole and the sole plate between the toe end of the sole structure and the widest section of the sole structure, a rear midsole directly coupled to the top midsole and the sole plate between the heel end of the sole structure and the narrowest section of the sole structure, and an outsole defining a ground engaging surface and directly coupled to the front midsole and the rear midsole. The narrowest section of the sole structure is defined by a narrowest section of the top midsole.

An article of footwear having a sole structure and an upper, the sole structure comprising a widest section, a narrowest section, a toe end, a heel end, a lateral side, and a medial side. The sole structure further comprises a top midsole directly coupled to an underside of the upper, a sole plate directly coupled to an underside of the top midsole, a front midsole directly coupled to the underside of the top midsole and an underside of the sole plate between the toe end of the sole structure and the widest section of the sole structure, a rear midsole directly coupled to the underside of the top midsole and the underside of the sole plate between the heel end of the sole structure and the narrowest section of the sole structure, and an outsole defining a ground engaging surface and directly coupled to an underside of the front midsole and an underside of the rear midsole. The outsole includes a first outsole section that is directly coupled to the underside of the front midsole, a second outsole section that is directly coupled to the underside of the rear midsole on the lateral side of the sole structure, and a third outsole section that is directly coupled to the underside of the rear midsole on the medial side of the sole structure. The second outsole section is longer than the third outsole section.

In some embodiments, the sole plate includes a plurality of peaks and a plurality of valleys on the lateral side of an outer edge of the sole plate between a widest section of the sole plate and a toe end of the sole plate. In some embodiments, the plurality of peaks of the sole plate includes at least three peaks, and the plurality of valleys of the sole plate includes at least two valleys. Additionally, in some embodiments, the outsole includes a first outsole section, a second outsole section, and a third outsole section. The first outsole section is directly coupled to an underside of the front midsole, the second outsole section is directly coupled to the lateral side of an underside of the rear midsole, and the third outsole section is directly coupled to the medial side of the underside of the rear midsole. In some embodiments, the front midsole includes a notch, the first outsole section includes a notch, and the sole plate includes a first aperture. The notch of the front midsole, the notch of the first outsole section, and the first aperture of the sole plate are aligned with each other.

In some embodiments, the second outsole section and the third outsole section are directly coupled to an underside of the rear midsole. In some embodiments, the second outsole section is disposed on the lateral side of the underside of the rear midsole, the third outsole section is disposed on the medial side of the underside of the rear midsole, and the rear midsole includes a gap that is disposed between the second outsole section and the third outsole section. In some embodiments, the top midsole includes a plurality of ribs, the sole plate includes a plurality of ribs, and the front midsole includes a plurality of depressions. The plurality of depressions of the front midsole receive the plurality of ribs of the sole plate, and the plurality of ribs of the sole plate receive the plurality of ribs of the top midsole. In some embodiments, a toe end of the outsole surrounds a toe end of the front midsole, such that the toe end of the front midsole surrounds a toe end of the sole plate, and the toe end of the sole plate, the toe end of the front midsole, and the toe end of the outsole extend farther forward than a toe end of the top midsole.

In some embodiments, the front midsole includes a convex portion and a concave portion on the medial side and a convex portion on the lateral side. The concave portion of the medial side is disposed closer to a toe end of the sole structure than a convex portion of the medial side, and a point of the rear midsole is formed where the convex curve of the lateral side and the concave curve of the medial side meet. The point of the rear midsole extends farther toward the toe end of the sole structure than the rest of the rear midsole, and the point of the rear midsole is disposed primarily on the lateral side of the sole structure. In some embodiments, a lateral side of the top midsole includes a depression, a medial side of the top midsole includes a depression, and the rear midsole includes a lip on an outer edge of the rear midsole. The depression of the lateral side of the top midsole receives the lip of the rear midsole, and the depression of the medial side of the top midsole receives the lip of the rear midsole.

In some embodiments, the outsole includes a first outsole section, and the first outsole section is directly coupled to an underside of the front midsole. In some embodiments, the underside of the front midsole includes a medial side exposed section and a lateral side exposed section, and the medial side exposed section and the lateral side exposed section are sections of the underside of the front midsole that are not directly coupled to the first outsole section. In some embodiments, the sole plate includes a first rib and a second rib. A front end of the first rib and a front end of the second rib each extend to a point between the widest section of the sole structure and the toe end of the sole structure, and a rear end of the first rib and a rear end of the second rib each extend to a point between the narrowest section of the sole structure and the heel end of the sole structure. In some embodiments, the sole plate includes a third rib, and the third rib is disposed entirely between the widest section of the sole structure and the toe end of the sole structure. In some embodiments, a heel end of the sole plate is generally aligned with a heel end of the outsole. In some embodiments, the top midsole includes a plurality of medial side ridges and a plurality of lateral side ridges, and the rear midsole includes a plurality of medial side ridges and a plurality of lateral side ridges. In some embodiments, the toe end of the sole structure extends past a toe end of the upper.

In some embodiments, a medial side of an outer edge of the rear midsole includes a convex portion and a concave portion, a lateral side of the outer edge of the rear midsole includes a convex portion, the second outsole section is curved, and the third outsole section is curved. In some embodiments, the curve of the second outsole section is substantially the same as the convex portion of the lateral side of the outer edge of the rear midsole, and the curve of the third outsole section is substantially the same as the convex portion of the medial side of the outer edge of the rear midsole. In some embodiments, the medial side of the outer edge of the rear midsole includes a transition point, and the third outsole section is entirely disposed between the transition point and the heel end of the sole structure.

DETAILED DESCRIPTION OF THE DRAWINGS

Figure 1:
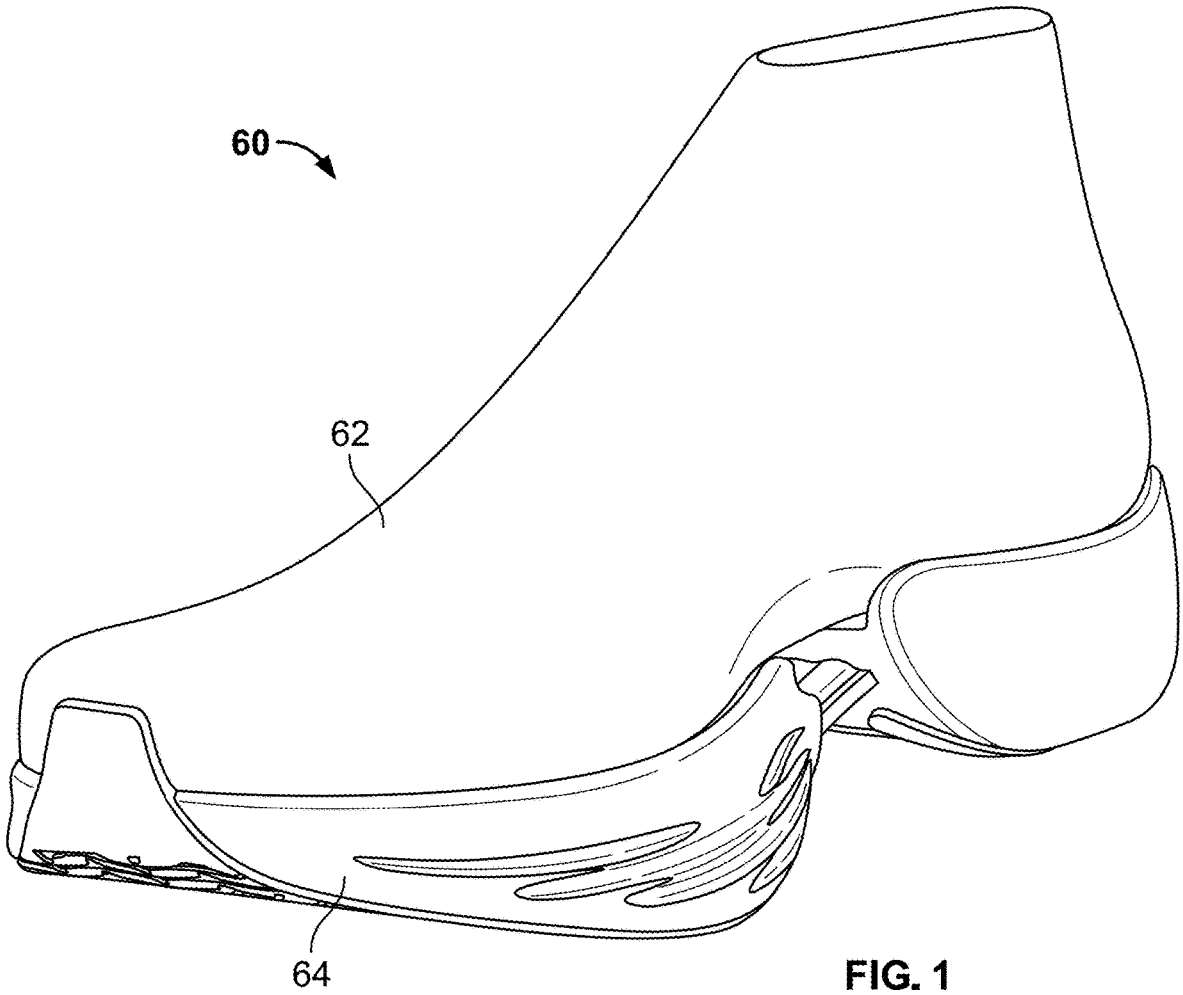
FIG. 1 is a front isometric view of an article of footwear shown as a sports shoe that includes an upper and a sole structure attached thereto.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper, a sole or sole structure, and/or a sole plate. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

FIG. 1 depicts an exemplary embodiment of an article of footwear 60 including an upper 62 and a sole structure 64. The upper 62 is attached to the sole structure 64 and together define an interior cavity into which a foot may be inserted. The sole structure 64 is connected or secured to the upper 62 and extends between a foot of a user and the ground when the article of footwear 60 is worn by the user. The sole structure 64 may include one or more components, which may include a top midsole, a sole plate, a front midsole, a rear midsole, and an outsole. For example, in some embodiments, a sole structure 64 may include an outsole that provides structural integrity to the sole structure, along with providing traction for a user, one or more midsoles that provides a cushioning system, and a sole plate that provides additional durability, stability, and propulsion. As will be further discussed herein, the sole structure 64 of the present embodiment of the disclosure includes one or more components that provide the sole structure 64 with preferable spring and damping properties.

Figure 2:
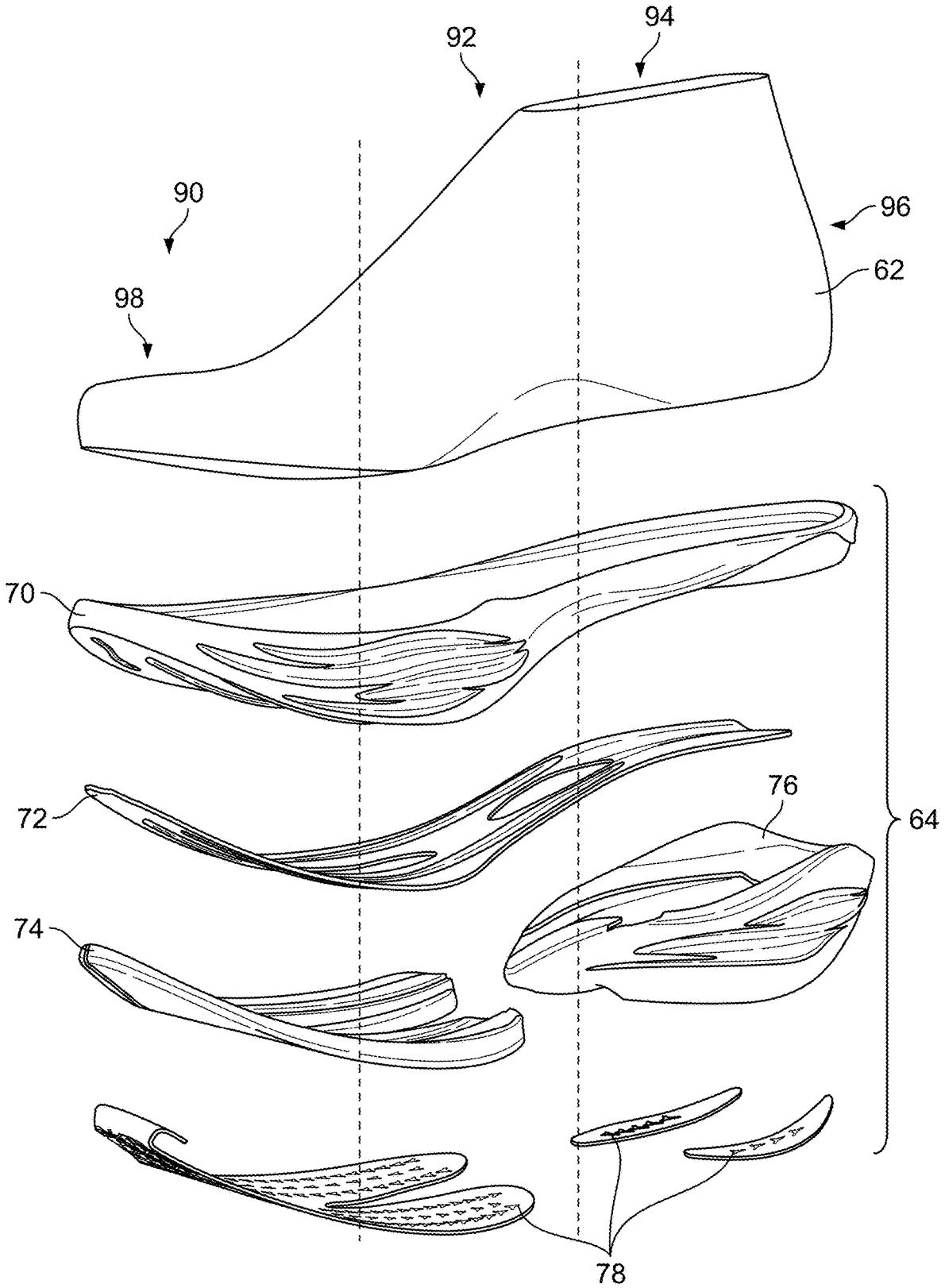
FIG. 2 is an exploded view of the shoe of FIG. 1 including a top midsole, a plate, a front midsole, a rear midsole, and an outsole.

Referring to FIG. 2, the sole structure 64 includes a first or top midsole 70, a sole plate 72, a second or front midsole 74, a third or rear midsole 76, and an outsole 78. The top midsole 70 is directly coupled to and disposed below the upper 62, and is further directly coupled to and disposed on top of the sole plate 72. The sole plate 72 is directly coupled to and disposed on top of each of the front midsole 74 and the rear midsole 76. The front midsole 74 is disposed laterally forward and spaced from the rear midsole 76. The front midsole 74 and the rear midsole 76 are also each directly coupled to and disposed on top of spaced portions of the outsole 78. In some embodiments, the outsole 78 includes a plurality of sections or portions that are spaced from one another. In some embodiments, the front midsole 74 and the rear midsole 76 are directly coupled to different sections of the outsole 78.

In some embodiments, the top midsole 70, the front midsole 74, and the rear midsole 76 are individually constructed from a thermoplastic material, such as polyurethane (PU), for example, and/or an ethylene-vinyl acetate (EVA), copolymers thereof, or a similar type of material. In other embodiments, the top midsole 70, the front midsole 74, and/or the rear midsole 76 are an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. In some embodiments, the top midsole 70, the front midsole 74, and/or the rear midsole 76 are a single polymeric material. In some embodiments, the top midsole 70, the front midsole 74, and/or the rear midsole 76 are a blend of materials, such as an EVA copolymer, a thermoplastic polyurethane, a polyether block amide (PEBA) copolymer, and/or an olefin block copolymer. One example of a PEBA material is PEBAX®.

In embodiments where the top midsole 70, the front midsole 74, and/or the rear midsole 76 are formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which is used as the top midsole 70, the front midsole 74, and the rear midsole 76. In further embodiments, the top midsole 70, the front midsole 74, and the rear midsole 76 are formed using alternative methods known in the art, including the use of an expansion press, an injection machine, a pellet expansion process, a cold foaming process, a compression molding technique, die cutting, or any combination thereof. For example, the top midsole 70, the front midsole 74, and/or the rear midsole 76 are formed using a process that involves an initial foaming step in which supercritical gas is used to foam a material and then compression molded or die cut to a particular shape.

In some embodiments, the sole plate 72 comprises a PU plastic, such as a thermoplastic polyurethane (TPU) material, for example. Other thermoplastic elastomers consisting of block copolymers are also possible. In some embodiments, the sole plate 72 can include carbon fiber, for example. In some embodiments, the outsole 78 defines a bottom end or surface of the sole structure 64. Further, in some embodiments, the outsole 78 is a ground-engaging portion or includes a ground-engaging surface of the sole structure 64 and is opposite of an insole (not pictured) thereof. The outsole 78 is formed from one or more materials to impart durability, wear-resistance, abrasion resistance, or traction to the sole structure 64, and the outsole 78 of the sole structure 64 can include a plurality of sections in some embodiments.

As shown in FIG. 2, the article of footwear 60 defines a forefoot region 90, a midfoot region 92, and a heel region 94. The forefoot region 90 generally corresponds with portions of the article of footwear 60 that encase portions of the foot that include the toes, the ball of the foot, and joints connecting the metatarsals with the toes or phalanges. The midfoot region 92 is proximate and adjoining the forefoot region 90, and generally corresponds with portions of the article of footwear 60 that encase the arch of foot, along with the bridge of the foot. The heel region 94 is proximate and adjoining the midfoot region 92 and generally corresponds with portions of the article of footwear 60 that encase rear portions of the foot, including the heel or calcaneus bone, the ankle, and/or the Achilles tendon.

The article of footwear 60 also includes a medial side 96 and a lateral side 98. In particular, the lateral side 98 corresponds to an outside portion of the article of footwear 60 and the medial side 96 corresponds to an inside portion of the article of footwear 60. As such, left and right articles of footwear have opposing lateral sides and medial sides, such that the medial sides are closest to one another when a user is wearing the articles of footwear, while the lateral sides are defined as the sides that are farthest from one another while being worn. The medial side 96 and the lateral side 98 adjoin one another at opposing, distal ends of the article of footwear 60.

Unless otherwise specified, the forefoot region 90, the midfoot region 92, the heel region 94, the medial side 96, and the lateral side 98 are intended to define boundaries or areas of the article of footwear 60. To that end, the forefoot region 90, the midfoot region 92, the heel region 94, the medial side 96, and the lateral side 98 generally characterize sections of the article of footwear 60. Further, both the upper 62 and the sole structure 64 are characterized as having portions within the forefoot region 90, the midfoot region 92, the heel region 94, and on the medial side 96 and the lateral side 98. Therefore, the upper 62 and the sole structure 64, and/or individual portions of the upper 62 and the sole structure 64, can include portions thereof that are disposed within the forefoot region 90, the midfoot region 92, the heel region 94, and on the medial side 96 and the lateral side 98. Further, the distal end of the article of footwear 60 in the forefoot region 90 intends to define a toe end of the article of footwear 60, and the distal end of the article of footwear 60 in the heel region 94 intends to define a heel end of the article of footwear 60.

The upper 62 and the sole structure 64, and/or individual portions of the upper 62 and the sole structure 64, can include portions thereof that are defined as the toe end or the heel end of said component. Still further, a central longitudinal plane runs from the toe end of the article of footwear 60 to the heel end of the article of footwear 60. A widest section of the article of footwear 60 is defined or measured along a first line that is perpendicular with respect to the central longitudinal plane. Additionally, a narrowest section of the article of footwear 60 is defined as the narrowest section of the article of footwear 60 and is measured across a second line that is perpendicular with respect to the central longitudinal plane. The upper 62 and the sole structure 64, and/or individual portions of the upper 62 and the sole structure 64, also define a central longitudinal plane, a widest section, and a narrowest section. Finally, "upward," "above," "downward," and "below" refer to the direction that would be observed when the article of footwear 60 is assembled and resting in a use position on a surface, wherein upward indicates a direction away from the surface and downward indicates a direction toward the surface. To that end, above means relatively farther from the surface, and below means relatively closer to the surface. Further, an upper side of the upper 62 and the sole structure 64, and/or individual portions of the upper 62 and the sole structure 64, is defined as the face of the component that is farthest from the surface, and the underside of the component is a face of the component that is closest to the surface.

Figure 3:
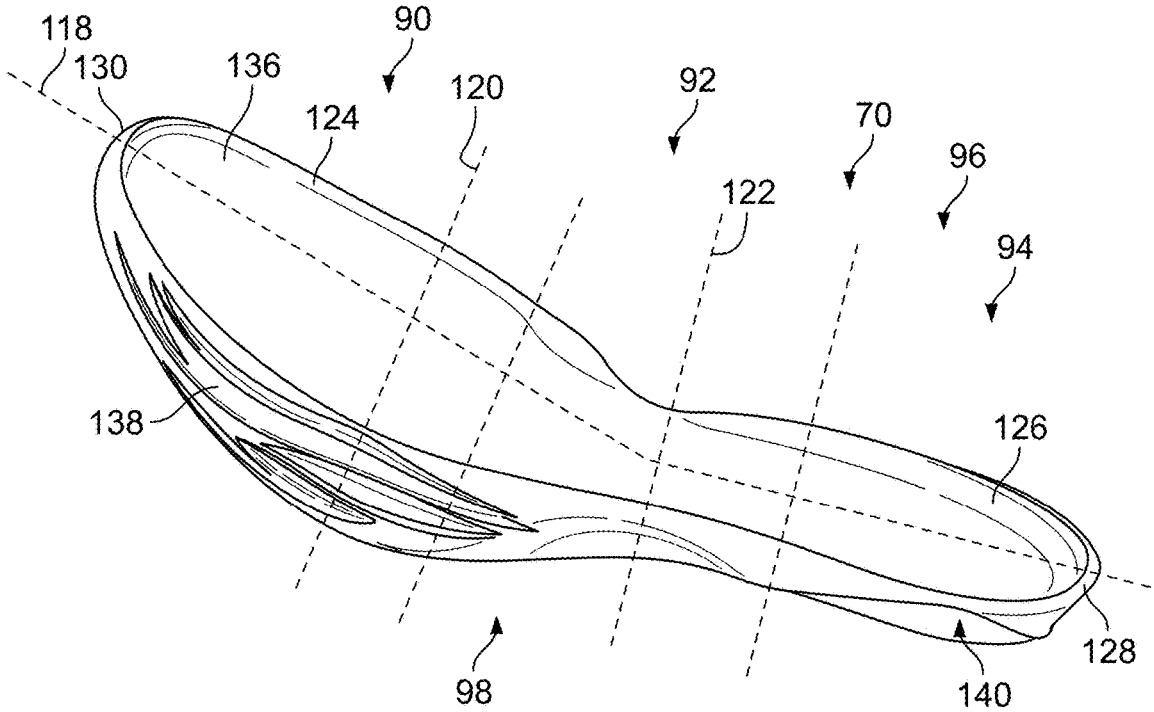
FIG. 3 is a top isometric view of the top midsole of FIG. 2.

Turning to FIG. 3, the top midsole 70 of the sole structure 64 is illustrated in detail. A central longitudinal plane 118 of the top midsole 70 is illustrated. A widest section of the top midsole 70 is measured across a first top midsole line 120 and a narrowest section of the top midsole 70 is measured across a second top midsole line 122. An outer edge 124 of the top midsole 70 extends farther upward than the rest of the top midsole 70, creating a lip 126 on the outside of the top midsole 70. The lip 126 of the top midsole 70 is thickest, i.e., extends the largest amount upward, at a heel end 128 of the top midsole 70. The thickness of the lip 126 of the top midsole 70 generally reduces from the heel end 128 toward the midfoot region 92 of the top midsole 70, and has a thickness of zero along the second top midsole line 122. The lip 126 of the top midsole 70 at a toe end 130 of the top midsole 70 defines a non-zero thickness, but the lip 126 is not as thick at the toe end 130 of the top midsole 70 as the lip 126 is at the heel end 128 of the top midsole 70. The thickness of the lip 126 of the top midsole 70 generally reduces from the toe end 130 toward the midfoot region 92 of the top midsole 70, and has a thickness of zero along the second top midsole line 122.

Still referring to FIG. 3, an upper side 136 of the top midsole 70 is relatively flat except for the lip 126 of the top midsole 70. The lateral side 98 of the top midsole 70 includes a plurality of ridges 138 that run from the toe end 130 of the top midsole 70 toward the second top midsole line 122. In some embodiments, the ridges 138 do not extend entirely to the toe end 130 of the top midsole 70, nor do the ridges 138 extend entirely to the second top midsole line 122. Further, in some embodiments, the ridges 138 extend from a point between the toe end 130 of the top midsole 70 and the first top midsole line 120 to a point between the first top midsole line 120 and the second top midsole line 122. In some embodiments, the lateral side 98 of the top midsole 70 in the heel region 94 includes a lateral side depression 140. The lateral side depression 140 is a consistent depth throughout, and is relatively triangular. The lateral side depression 140 is disposed entirely between the second top midsole line 122 and the heel end 128 of the top midsole 70.

With continued reference to FIG. 3, the top midsole 70 has a varying thickness. More specifically, the thickness of the top midsole 70 reduces between the first top midsole line 120 and the toe end 130 of the top midsole 70. The top midsole 70 is thickest between the first top midsole line 120 and the second top midsole line 122. More specifically, the thickest section of the top midsole 70 is disposed closer to the first top midsole line 120 than the second top midsole line 122. The thickness of the top midsole 70 is substantially constant between the second top midsole line 122 and the heel end 128 of the top midsole 70.

Figure 4:
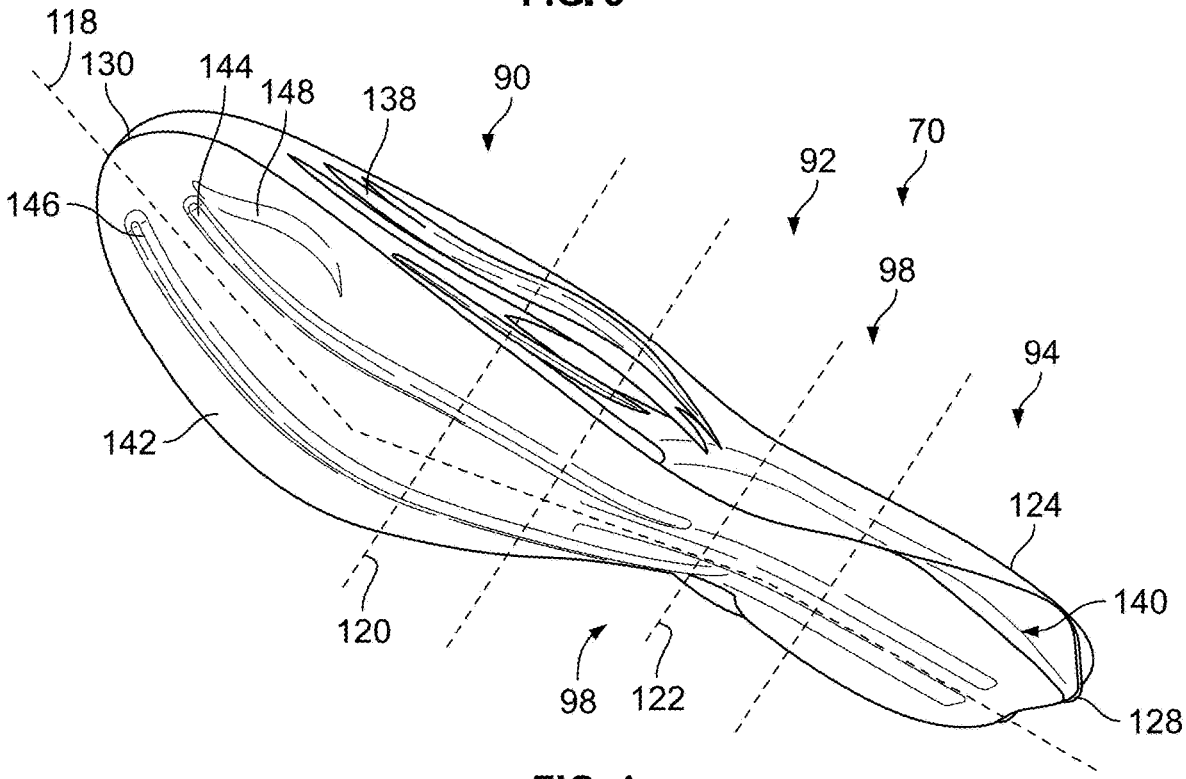
FIG. 4 is a bottom isometric view of the top midsole of FIG. 3.

FIG. 4 illustrates an underside 142 of the top midsole 70. The underside 142 of the top midsole 70 of the sole structure 64 includes a first rib 144, a second rib 146, and a third rib 148. The first rib 144 and the second rib 146 extend from the forefoot region 90, through the midfoot region 92, and into the heel region 94. The first rib 144 and the second rib 146 do not extend entirely to the toe end 130 of the top midsole 70. The first rib 144 and the second rib 146 extend to a point between first top midsole line 120 and the toe end 130 of the top midsole 70 on one end. The first rib 144 and the second rib 146 extend to a point between the second top midsole line 122 and the heel end 128 of the top midsole 70 on the other end. The third rib 148 is disposed primarily in the forefoot region 90. In some embodiments, the third rib 148 is disposed entirely between the first top midsole line 120 and the toe end 130 of the top midsole 70. In some embodiments, the first rib 144, the second rib 146, and the third rib 148 are generally curved in shape. The first rib 144, the second rib 146, and the third rib 148 extend downward and outward from the underside 142 of the top midsole 70.

Like the lateral side 98 of the top midsole 70, the medial side 96 of the top midsole 70 (not pictured) includes a plurality of ridges that run from the toe end 130 of the top midsole 70 toward the second top midsole line 122. In some embodiments, the medial side ridges do not extend entirely to the toe end 130 of the top midsole 70, nor do the medial side ridges extend entirely to the second top midsole line 122. Further, in some embodiments, the medial side ridges extend from a point between the toe end 130 of the top midsole 70 and the first top midsole line 120 to a point between the first top midsole line 120 and the second top midsole line 122. In some embodiments, the medial side 96 of the top midsole 70 in the heel region 94 includes a depression. The depression is a consistent depth throughout and is relatively triangular. The depression is disposed entirely between the second top midsole line 122 and the heel end 128 of the top midsole 70. In some embodiments, the medial side 96 ridges of the top midsole 70 are substantially the same as the lateral side 98 ridges of the top midsole 70. Further, in some embodiments, the medial side depression is substantially the same as the lateral side depression 140.

Figure 5:
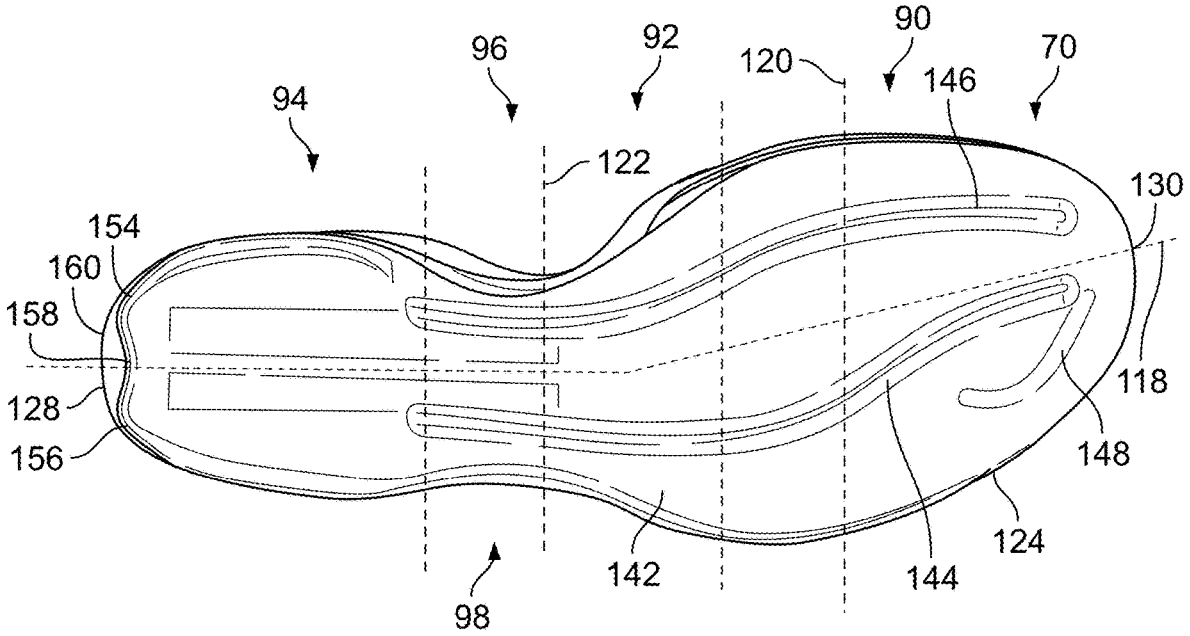
FIG. 5 is a bottom plan view of the top midsole of FIG. 3.

Turning to FIG. 5, the first rib 144, the second rib 146, and the third rib 148 of the top midsole 70 are illustrated in more detail. In some embodiments, the first rib 144 and the second rib 146 are the same shape. In some embodiments, the first rib 144 and the second rib 146 are different shapes. Further, as shown in FIG. 5, a lower profile of the heel end 128 of the top midsole 70 includes a first heel peak 154 and a second heel peak 156 that are separated by a heel valley 158. Further, the lip 126 of the top midsole 70 extends upward and outward at the heel end 128, resulting in a protrusion 160 at the heel end 128 of the top midsole 70.

Figure 6:
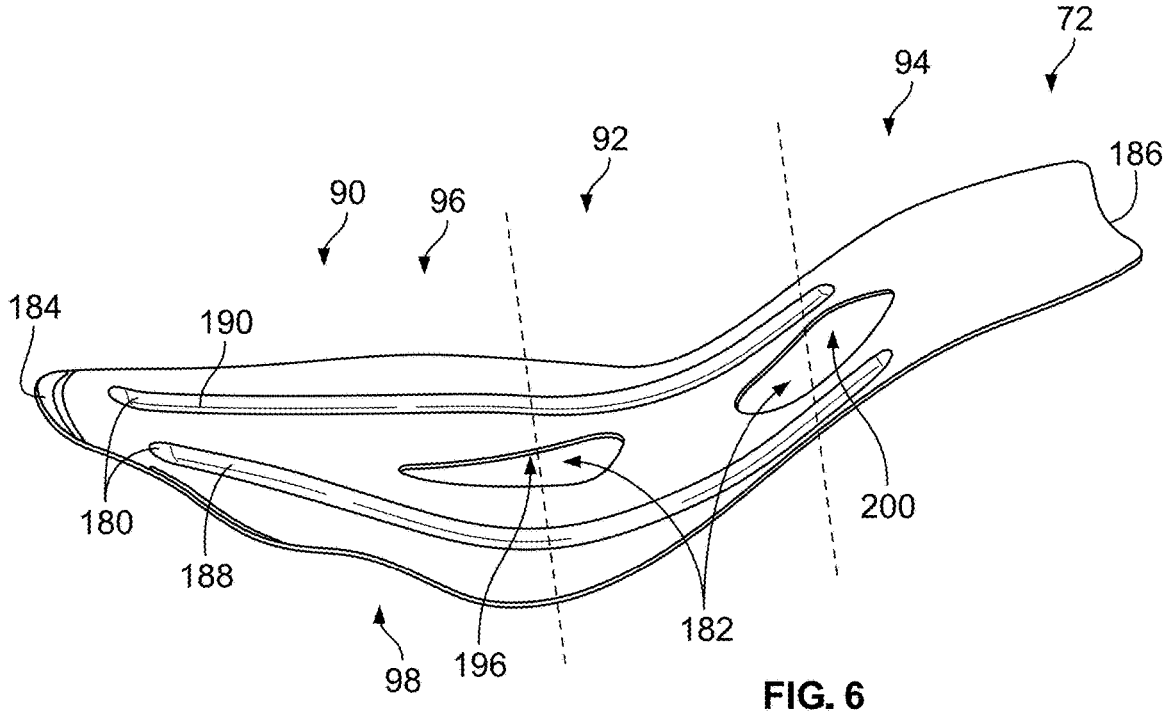
FIG. 6 is a top isometric view of the plate of FIG. 2.

Referring to FIG. 6, the sole plate 72 is illustrated in more detail. The sole plate 72 includes a plurality of ribs 180 and a plurality of apertures 182. The plurality of ribs 180 runs longitudinally along the sole plate 72 from the forefoot region 90 to the heel region 94. In the illustrated embodiment, the plurality of ribs 180 does not extend entirely to a toe end 184 of the sole plate 72 or to a heel end 186 of the sole plate 72. However, in some embodiments, the plurality of ribs 180 extends entirely to the toe end 184 and/or to the heel end 186. In the illustrated embodiment, the plurality of ribs 180 extends radially downward. In some embodiments, the plurality of ribs 180 extends radially upward. In the illustrated embodiments, the sole plate 72 includes a first rib 188 and a second rib 190. In some embodiments, the sole plate 72 has more or fewer ribs. In some embodiments, the ribs 180 are different in length or shape, the ribs 180 are placed differently, or the ribs 180 are sized differently.

Still referring to FIG. 6, a first aperture 196 of the plurality of apertures 182 is disposed partially in the forefoot region 90 and partially in the midfoot region 92. The first aperture 196 is generally rounded and tapers at a forward end 198 of the first aperture 196. A second aperture 200 of the plurality of apertures 182 is generally disposed within the midfoot region 92 and the heel region 94. The second aperture 200 is irregularly shaped. In some embodiments, the first aperture 196 and the second aperture 200 are the same shape, are positioned differently, or are sized differently. In some embodiments, there are more or fewer apertures. The apertures 182 are advantageous to allow a medial side 96 and a lateral side 98 of the sole plate 72 to flex independent of one another.

Figure 7:
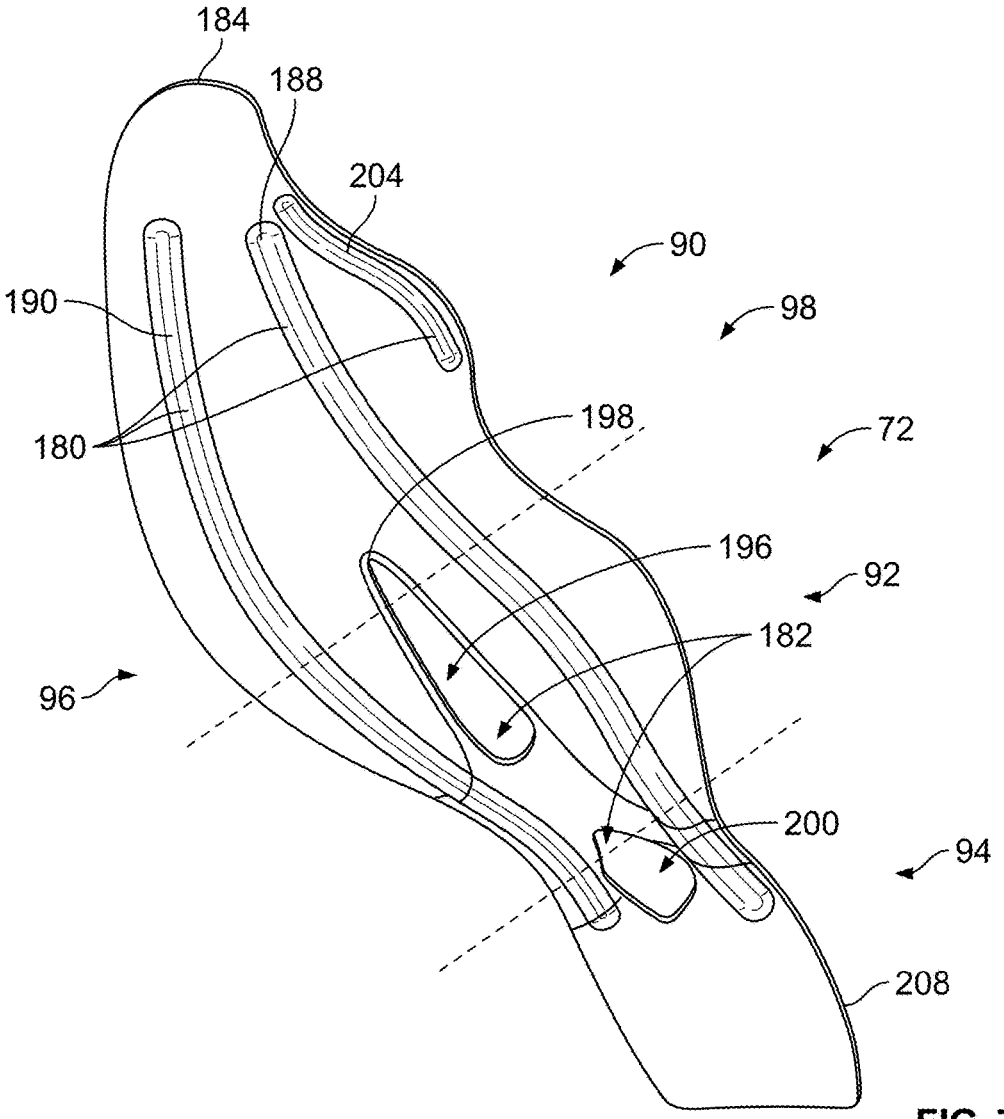
FIG. 7 is a bottom isometric view of the plate of FIG. 6.

Referring now to FIG. 7, the plurality of ribs 180 of the sole plate 72 includes a third rib 204 disposed along the lateral side 98 of the sole plate 72. The third rib 204 runs longitudinally along a portion of the lateral side 98 of the forefoot region 90 of the sole plate 72. The third rib 204 is slightly curved in shape, having a concave portion closer to the toe end 184 of the sole plate 72, and a convex portion closer to the heel end 186 of the sole plate 72. The third rib 204 generally follows the shape of an outer edge 208 of the sole plate 72 on the lateral side 98 of the forefoot region 90 of the sole plate 72. In some embodiments, the third rib 204 extends radially downward, i.e., by defining a generally cylindrical or spherical profile. In some embodiments, the third rib 204 extends radially downward by the same amount that the first rib 188 and the second rib 190 extend radially downward. In some embodiments, the third rib 204 extends radially downward a different distance than the first rib 188 and the second rib 190. In some embodiments, the third rib 204 is not included on the sole plate 72.

Figure 8:
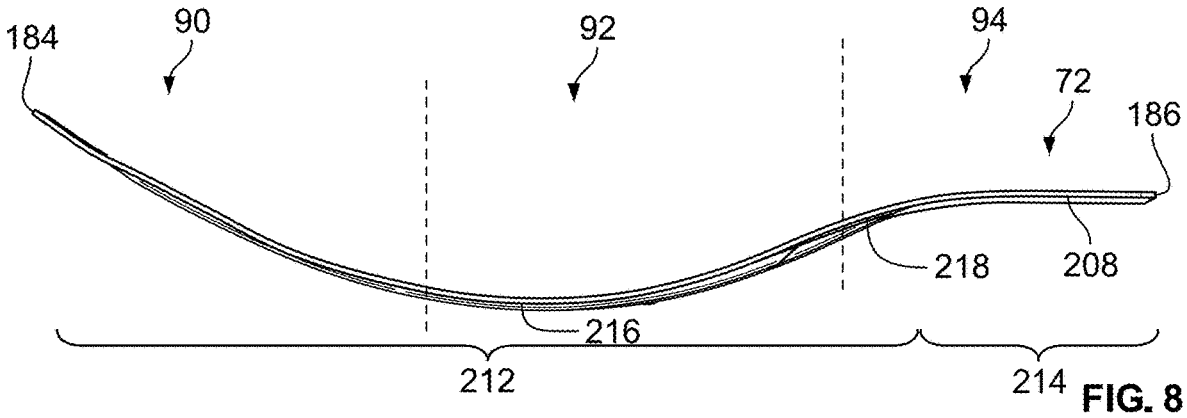
FIG. 8 is a side elevational view of the plate of FIG. 6.

Referring now to FIG. 8, the sole plate 72 includes a curved portion 212 and a rear portion 214. The rear portion 214 is relatively flat. The curved portion 212 is an anterior curved portion and includes one or more radii of curvature. The toe end 184 of the sole plate 72 curves upward, and a vertex 216 of the curved portion 212 is disposed in the forefoot region 90. The midfoot region 92 includes a transition point 218. The transition point 218 defines the point at which the sole plate 72 transitions from the curved portion 212 to the rear portion 214. In some embodiments, the sole plate 72 has a uniform thickness.

Figure 9:
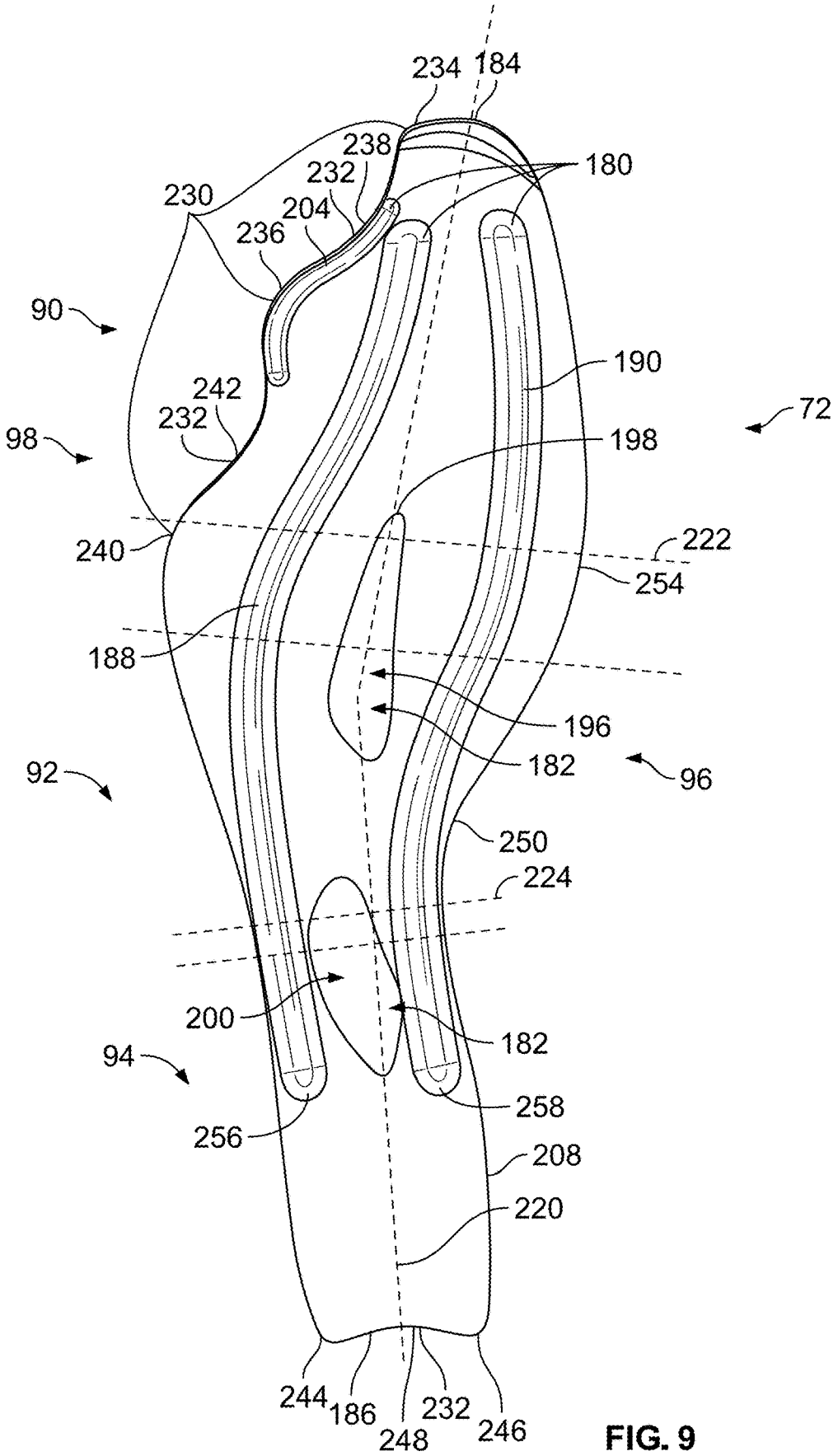
FIG. 9 is a bottom elevational view of the plate of FIG. 6.

Turning to FIG. 9, a bottom elevational view of the sole plate 72 is shown. The sole plate 72 generally widens in the forefoot region 90, narrows in the midfoot region 92, and remains a consistent width in the heel region 94. A first sole plate line 222 defines the widest section of the sole plate 72. In some embodiments, the first sole plate line 222 is disposed within the forefoot region 90. A second sole plate line 224 defines the narrowest section of the sole plate 72. In some embodiments, the second sole plate line 224 is disposed within the midfoot region 92.

Still referring to FIG. 9, the sole plate 72 defines the outer edge 208. The outer edge 208 of the sole plate 72 in the forefoot region 90 on the lateral side 98 defines a plurality of peaks 230 and a plurality of valleys 232. In the illustrated embodiment, the outer edge 208 defines three peaks and two valleys on the lateral side 98 of the forefoot region 90, but in some embodiments, there are more or fewer peaks and valleys. A first peak 234 of the plurality of peaks 230 is located at the toe end 184 of the sole plate 72. A second peak 236 of the plurality of peaks 230 is located on the lateral side 98 of the forefoot region 90. A first valley 238 separates the first peak 234 and the second peak 236. The first valley 238 defines a first radius of curvature. A third peak 240 is located on the lateral side 98 of the forefoot region 90. The third peak 240 is farther from the toe end 184 than the second peak 236. A second valley 242 separates the second peak 236 and the third peak 240. The second valley 242 defines a second radius of curvature. In some embodiments, the second radius of curvature is smaller than the first radius of curvature. In some embodiments, the second radius of curvature is the same as the first radius of curvature. In some embodiments, the second radius of curvature is larger than the first radius of curvature. The first peak 234, second peak 236, third peak 240, first valley 238, and second valley 242 are disposed on the lateral side 98 of the sole plate 72 between the toe end 184 of the sole plate 72 and the first sole plate line 222, i.e., the first peak 234, second peak 236, third peak 240, first valley 238, and second valley 242 are disposed on the lateral side 98 of the sole plate 72 between the toe end 184 of the sole plate 72 and the first sole plate line 222.

Still referring to the lateral side 98 of the sole plate 72 as shown in FIG. 9, the outer edge 208 of the sole plate 72 generally curves toward the central longitudinal plane 220 between the third peak 240 and the midfoot region 92. As such, the sole plate 72 narrows between the forefoot region 90 and the midfoot region 92. The outer edge 208 is generally straight through the midfoot region 92 and the heel region 94. At the heel end 186 of the sole plate 72, the outer edge 208 defines a first heel peak 244 and a second heel peak 246. The first heel peak 244 is on the lateral side 98 of the sole plate 72. The second heel peak 246 is on the medial side 96 of the sole plate 72. A first heel valley 248 separates the first heel peak 244 and the second heel peak 246. The first heel valley 248 defines a heel radius of curvature. In some embodiments, the heel radius of curvature is larger than the first radius of curvature and the second radius of curvature of the first valley 238 and the second valley 242 respectively. The outer edge 208 of the medial side 96 of the sole plate 72 is generally straight through the heel region 94. The outer edge 208 of the medial side 96 of the sole plate 72 generally curves toward the central longitudinal plane 220 in the midfoot region 92. As such, the sole plate 72 narrows in the midfoot region 92. The outer edge 208 of the medial side 96 of the sole plate 72 curves away from the central longitudinal plane 220 in between the midfoot region 92 and the forefoot region 90 on the medial side 96. As such, the outer edge 208 of the medial side 96 defines a medial side valley 250 in the midfoot region 92.

In some embodiments, the medial side valley 250 is disposed entirely between the heel end 186 of the sole plate 72 and the first sole plate line 222. In some embodiments, the medial side valley 250 is disposed between the first sole plate line 222 and the second sole plate line 224. In some embodiments, the medial side valley 250 is disposed on the second sole plate line 224. Further, the sole plate 72 widens between the midfoot region 92 and the forefoot region 90. Within the forefoot region 90, the outer edge 208 switches from curving away from the central longitudinal plane 220 to curving toward the central longitudinal plane 220. As such, the outer edge 208 of the medial side 96 defines a medial side peak 254. The medial side peak 254 is substantially disposed in the forefoot region 90. In some embodiments, the medial side peak 254 is disposed on the first sole plate line 222. In some embodiments, the medial side peak 254 is located between the toe end 184 of the sole plate 72 and the first sole plate line 222.

As shown in FIG. 9, the first rib 188 and the second rib 190 extend from the forefoot region 90, through the midfoot region 92, and into the heel region 94. In some embodiments, the first rib 188 and the second rib 190 do not extend entirely to the toe end 184 of the sole plate 72. The first rib 188 and the second rib 190 extend to a point between the first sole plate line 222 and the toe end 184 of the sole plate 72 on one end. The first rib 188 and the second rib 190 extend to a point between the second sole plate line 224 and the heel end 186 of the sole plate 72 on the other end. The first rib 188 and the second rib 190 do not extend entirely to the heel end 186 of the sole plate 72. The third rib 204 is illustrated primarily in the forefoot region 90. In some embodiments, the third rib 204 is entirely disposed between the first sole plate line 222 and the toe end 184 of the sole plate 72. In some embodiments, the third rib 204 follows the shape of the outer edge 208 of the sole plate 72. More specifically, the third rib 204 follows the first radius of curvature of the first valley 238 and the second radius of curvature of the second valley 242.

Figure 10:
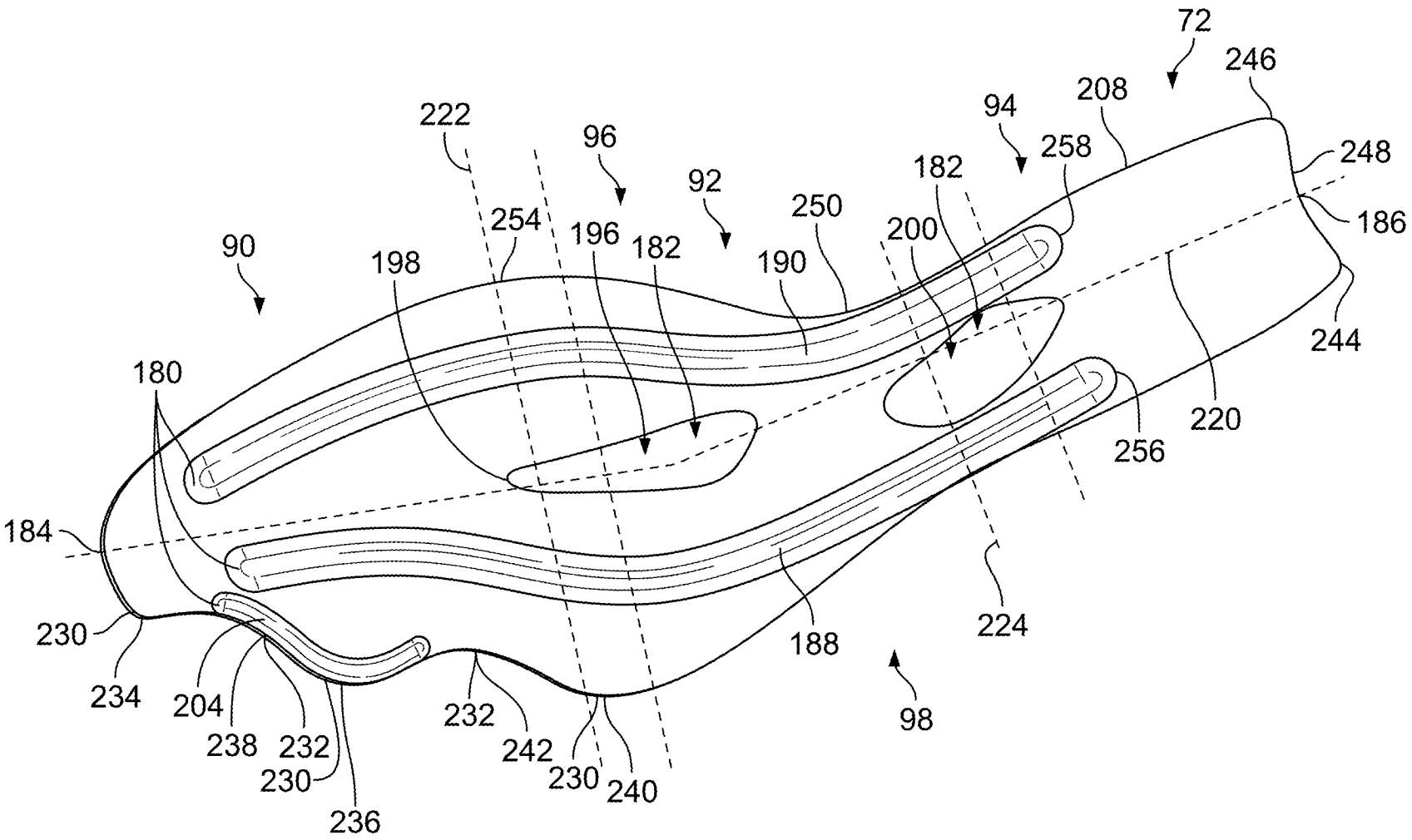
FIG. 10 is a top elevational view of the plate of FIG. 6.

As shown in FIG. 9, the first aperture 196 is substantially disposed within the forefoot region 90 of the sole plate 72. In some embodiments, a majority of the first aperture 196 is disposed between the first sole plate line 222 and the heel end 186 of the sole plate 72. In some embodiments, the first aperture 196 is disposed entirely between the first sole plate line 222 and the heel end 186 of the sole plate 72. In some embodiments, a section that is not a majority of the first aperture 196 is disposed between the first sole plate line 222 and the second sole plate line 224. The second aperture 200 is disposed within the midfoot region 92 and the heel region 94. In some embodiments, the second aperture 200 is disposed entirely between the first sole plate line 222 and the heel end 186 of the sole plate 72. In some embodiments, a majority of the second aperture 200 is disposed between the second sole plate line 224 and the heel end 186 of the sole plate 72. In some embodiments, the first aperture 196 is disposed between the first rib 188 and the second rib 190. In some embodiments, the second aperture 200 is disposed between the first rib 188 and the second rib 190. In some embodiments, the first aperture 196 and the second aperture 200 are disposed substantially forward of a rearmost point 256 of the first rib 188, wherein forward is defined as closer to the toe end 184 of the sole plate 72. In some embodiments, the first aperture 196 and the second aperture 200 are substantially disposed forward of a rearmost point 258 of the second rib 190. In some embodiments, the first rib 188 and the second rib 190 are generally curved. In some embodiments, the first rib 188 and the second rib 190 are generally straight. In some embodiments, the first rib 188 and the second rib 190 are positioned differently relative to the first aperture 196 and the second aperture 200. Turning to FIG. 10, a top view of the sole plate 72 is illustrated. Similar to FIG. 9, the outer edge 208, the first rib 188, the second rib 190, the third rib 204, the first aperture 196, and the second aperture 200 of the sole plate 72 are illustrated.

Figure 11:
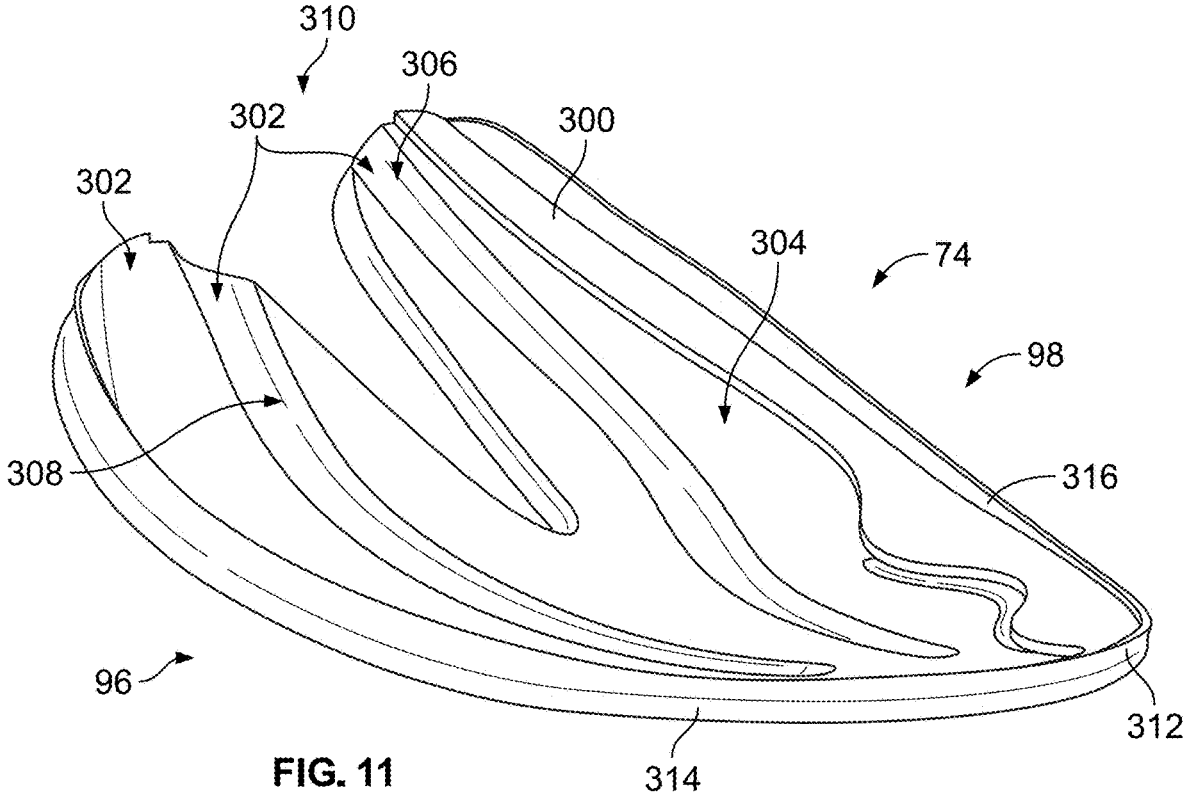
FIG. 11 is a top isometric view of the front midsole of FIG. 2.

As shown in FIG. 11, an upper side 300 of the front midsole 74 includes a plurality of depressions 302. A first depression 304 of the front midsole 74 has a thickness that is substantially equivalent to the thickness of the sole plate 72. A second depression 306 has a thickness that is substantially equivalent to the thickness of the first rib 188 of the sole plate 72. Similarly, a third depression 308 has a thickness that is substantially equivalent to the thickness of the second rib 190 of the sole plate 72. The first depression 304 and the second depression 306 extend from a rear end 310 of the front midsole 74 toward a toe end 312 of the front midsole 74. The second depression 306 and the third depression 308 are generally curved in shape, and the front midsole depressions 306, 308 do not have a constant depth throughout. An outer edge 314 of the front midsole 74 extends upward from the upper side 300 of the front midsole 74, creating a front midsole lip 316. The front midsole lip 316 is only disposed on the lateral side 98, medial side 96, and toe end 312 of the front midsole 74. The rear end 310 of the front midsole 74 does not include the front midsole lip 316.

Figure 12:
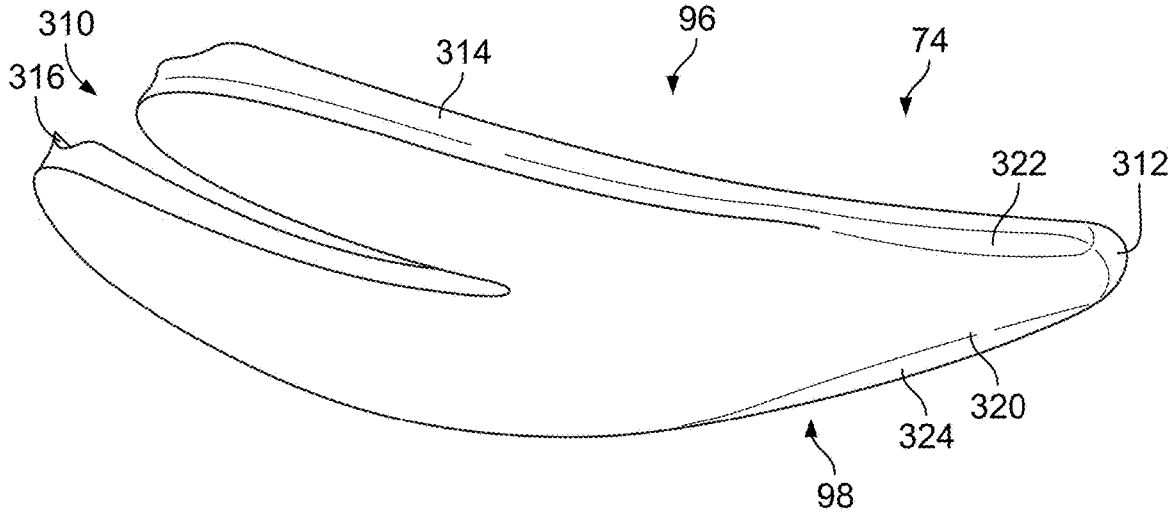
FIG. 12 is a bottom isometric view of the front midsole of FIG. 11.
Figure 13:
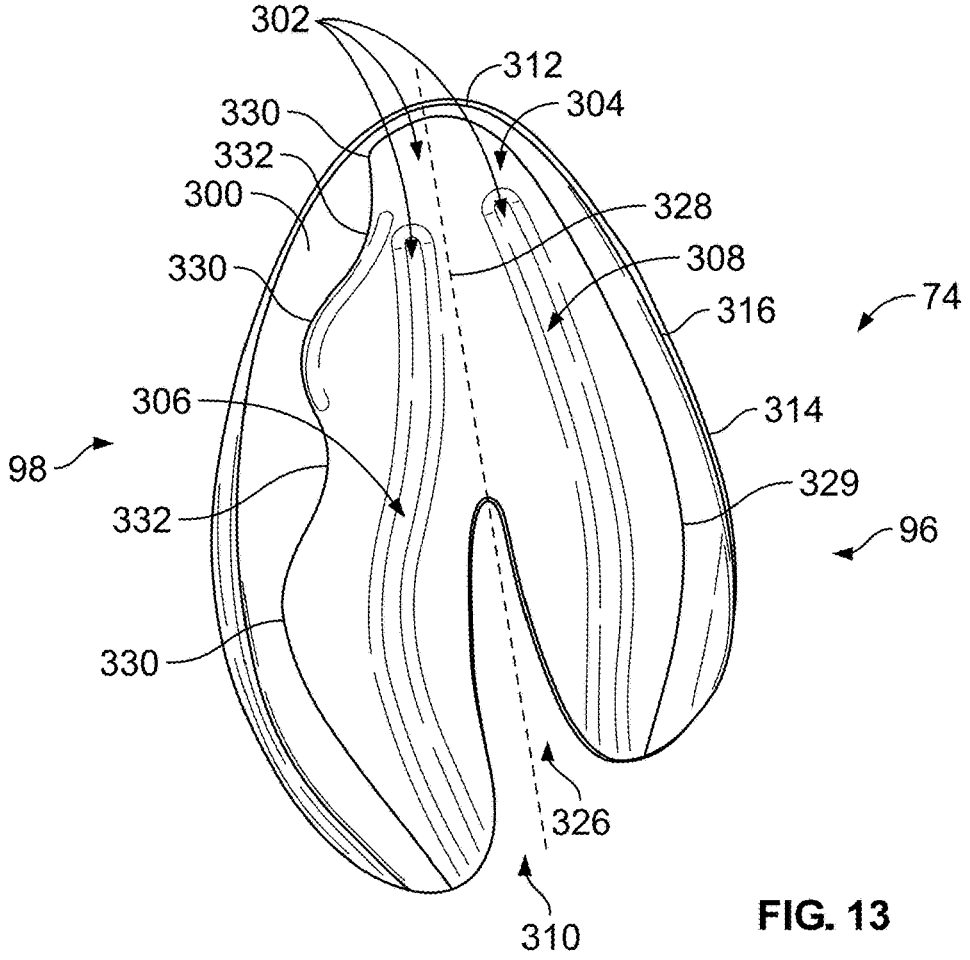
FIG. 13 is a top plan view of the front midsole of FIG. 11.

Turning to FIG. 12, an underside 320 of the front midsole 74 is generally smooth. The underside 320 of the front midsole 74 is slightly thicker at a medial side section 322 and a lateral side section 324. In some embodiments, the front midsole 74 does not have any ridges on the lateral side 98 or the medial side 96. Referring to FIG. 13, the front midsole 74 includes a notch 326. The notch 326 extends from the rear end 310 of the top midsole 70 toward the toe end 312 of the front midsole 74. The notch 326 runs generally along the central longitudinal plane 328, and runs between the second depression 306 of the front midsole 74 and the third depression 308 of the front midsole 74. The notch 326 is thickest at the rear end 310 of the top midsole 70, and tapers as it extends toward the toe end 312. Additionally, an outer edge 329 of the first depression 304 includes a plurality of peaks 330 and a plurality of valleys 332 on the lateral side 98 of the first depression 304. The plurality of peaks 330 and the plurality of valleys 332 of the first depression 304 are generally the same as the plurality of peaks 230 (see FIG. 9) and the plurality of valleys 232 (see FIG. 9) of the sole plate 72.

Figure 14:
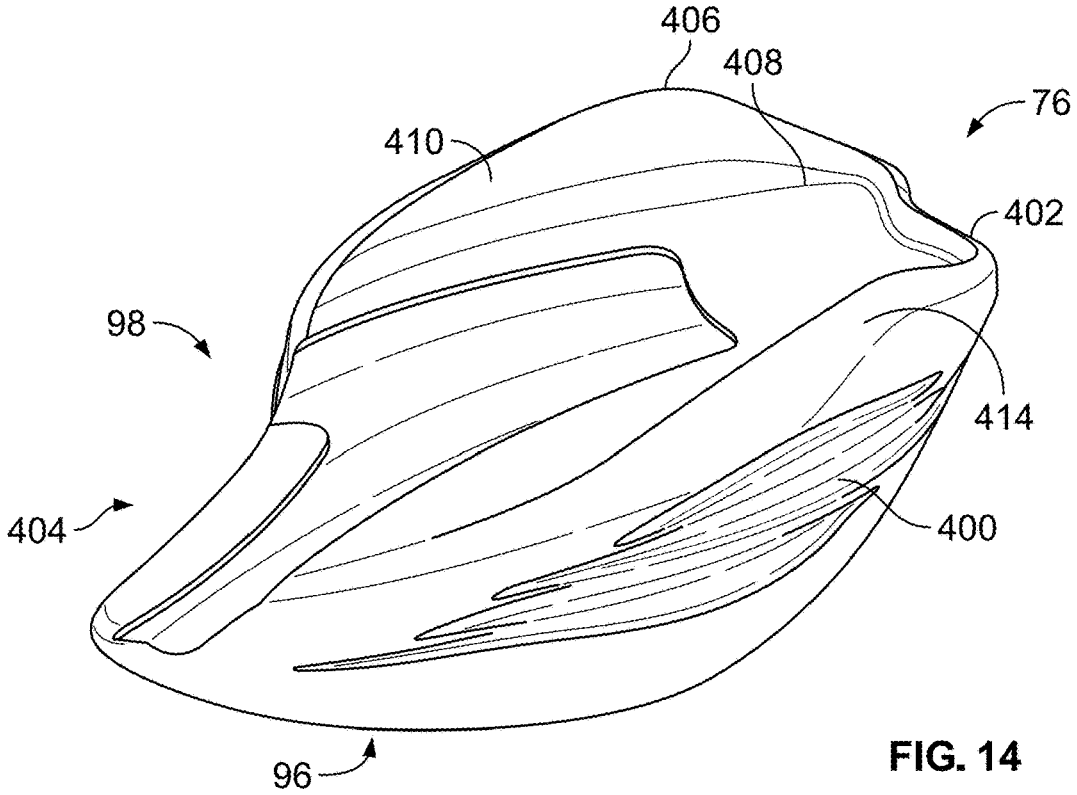
FIG. 14 is a top isometric view of the rear midsole of FIG. 2.

Referring now to FIG. 14, the rear midsole 76 is shown in detail. The rear midsole 76 includes a plurality of medial side ridges 400 on the medial side 96. The medial side ridges 400 run generally from a heel end 402 of the rear midsole 76 toward a front end 404 of the rear midsole 76, wherein the front end 404 of the rear midsole 76 is defined as the distal end opposite the heel end 402 of the rear midsole 76. In some embodiments, the medial side ridges 400 do not extend entirely to the heel end 402 of the rear midsole 76. In some embodiments, the medial side ridges 400 do not extend entirely to the front end 404 of the rear midsole 76. In some embodiments, the medial side ridges 400 are different shapes and lengths from each other.

Still referring to FIG. 14, an outer edge 406 of the rear midsole 76 on the medial side 96, heel end 402, and lateral side 98 is raised upward relative to the rest of an upper side 408 of the rear midsole 76, resulting in a lip 410 on the medial side 96, heel end 402, and lateral side 98 of the rear midsole 76. The front end 404 of the rear midsole 76 does not include the lip 410 of the rear midsole 76. The lip 410 of the rear midsole 76 is thickest on the lateral side 98 and medial side 96 of the rear midsole 76. In some embodiments, a medial side section 412 of the rear midsole lip 410 is about the same as a lateral side section 414 of the rear midsole lip 410.

Figure 15:
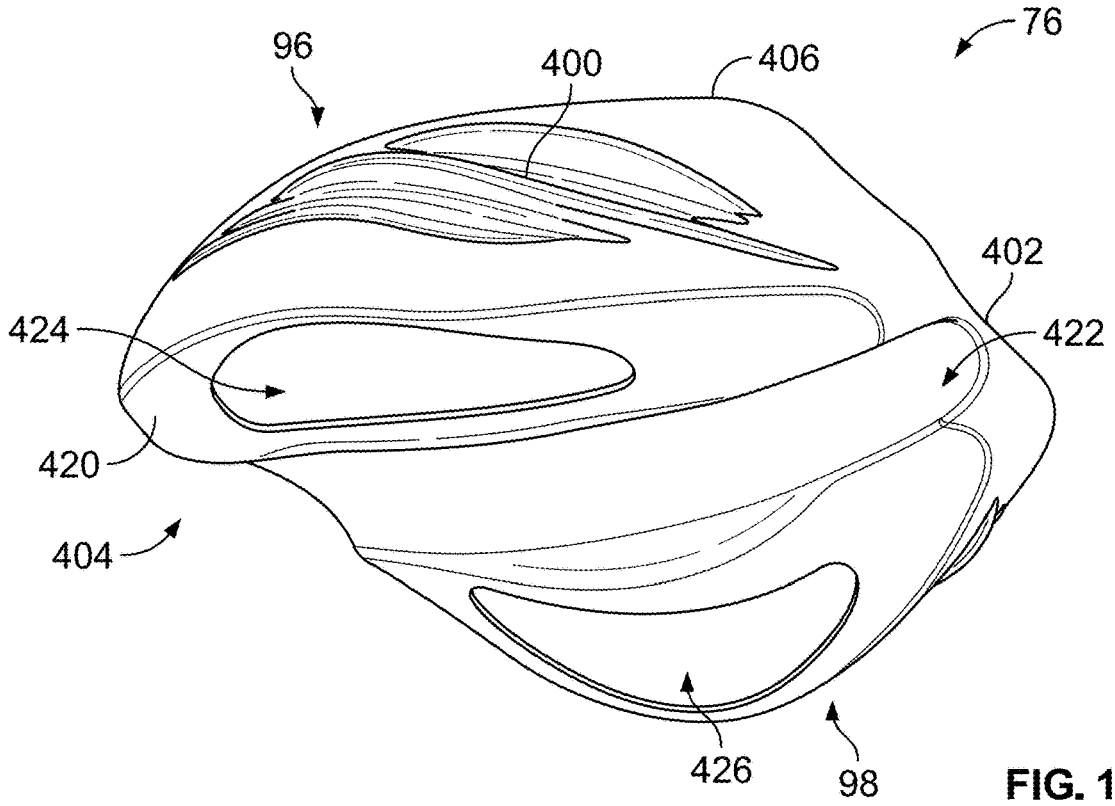
FIG. 15 is a bottom isometric view of the rear midsole of FIG. 14.

Now referring to FIG. 15, an underside 420 of the rear midsole 76 is illustrated. The underside 420 of the rear midsole 76 defines a gap 422. The gap 422 runs substantially along the central longitudinal plane 430 and extends upward and inward from the underside 420 of the rear midsole 76. The gap 422 of the rear midsole 76 extends entirely from the heel end 402 of the rear midsole 76 to the front end 404 of the rear midsole 76. The depth and width of the gap 422 varies. The gap 422 is widest at the front end 404 and generally narrows toward the heel end 402. The underside 420 of the rear midsole 76 includes a first recess 424 on the medial side 96 of the gap 422 and a second recess 426 on the lateral side 98 of the gap 422.

Figure 16:
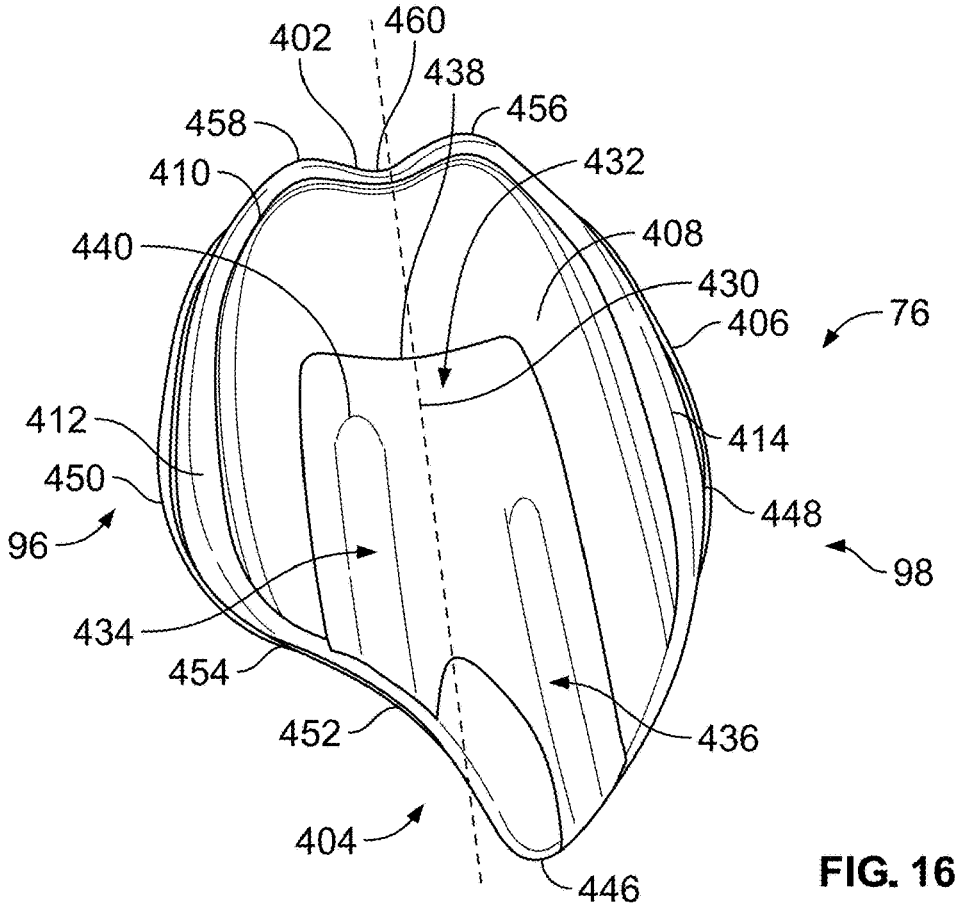
FIG. 16 is a top plan view of the rear midsole of FIG. 14.

As shown in FIG. 16, the underside 420 (see FIG. 15) of the rear midsole 76 is wider than the upper side 408 of the rear midsole 76, because the lateral side 98 of the lip 410 of the rear midsole 76 and the medial side 96 of the lip 410 of the rear midsole 76 taper inward as the lip 410 extends upward. The upper side 408 of the top midsole 70 includes a first depression 432, a second depression 434, and a third depression 436. The first depression 432 runs from the front end 404 of the rear midsole 76 toward the heel end 402 of the rear midsole 76, but does not extend entirely to the heel end 402 of the rear midsole 76. A rear end 438 of the first depression 432 curves forward. The second depression 434 of the rear midsole 76 also runs from the front end 404 of the rear midsole 76 toward the heel end 402 of the rear midsole 76, but does not extend entirely to the heel end 402 of the rear midsole 76. Further, a rear end 440 of the second depression 434 does not extend past the rear end 438 of the first depression 432. The second depression 434 is deeper than the first depression 432, and generally curved in shape. The third depression 436 extends from the front end 404 of the rear midsole 76 toward the heel end 402. The third depression 436 does not extend as far as the first depression 432 or the second depression 434. Further, the third depression 436 is deeper than the first depression 432, but shallower than the second depression 434. Both the second depression 434 and the third depression 436 are disposed within the first depression 432, and both the second depression 434 and the third depression 436 have a varying thickness.

Still referring to FIG. 16, the front end 404 of the rear midsole 76 extends to a point 446. The point 446 is disposed proximate the lateral side 98 of the rear midsole 76. The lateral side 98 of the rear midsole 76 is defined by a convex curve 448, and the medial side 96 of the rear midsole 76 is defined by a convex curve 450 and a concave curve 452. The point at which the convex curve 450 of the medial side 96 meets the concave curve 452 of the medial side 96 defines a point of inflection 454 of the rear midsole 76. Further, the point at which the convex curve 448 of the lateral side 98 meets the concave curve 452 of the medial side 96 defines the point 446 of the front end 404 of the rear midsole 76. In some embodiments, the point 446 of the rear midsole 76 defines the forwardmost point of the rear midsole 76.

Still referring to FIG. 16, the heel end 402 of the rear midsole 76 includes a first heel peak 456, a second heel peak 458, and a heel valley 460 disposed between the first heel peak 456 and the second heel peak 458. The first heel peak 456 and the second heel peak 458 are generally the same shape. The radius of curvature of the first heel peak 456 and the radius of curvature of the second heel peak 458 are generally the same. The radius of curvature of the heel valley 460 is generally larger than the radius of curvature of the first heel peak 456 and the radius of curvature of the second heel peak 458.

Figure 17:
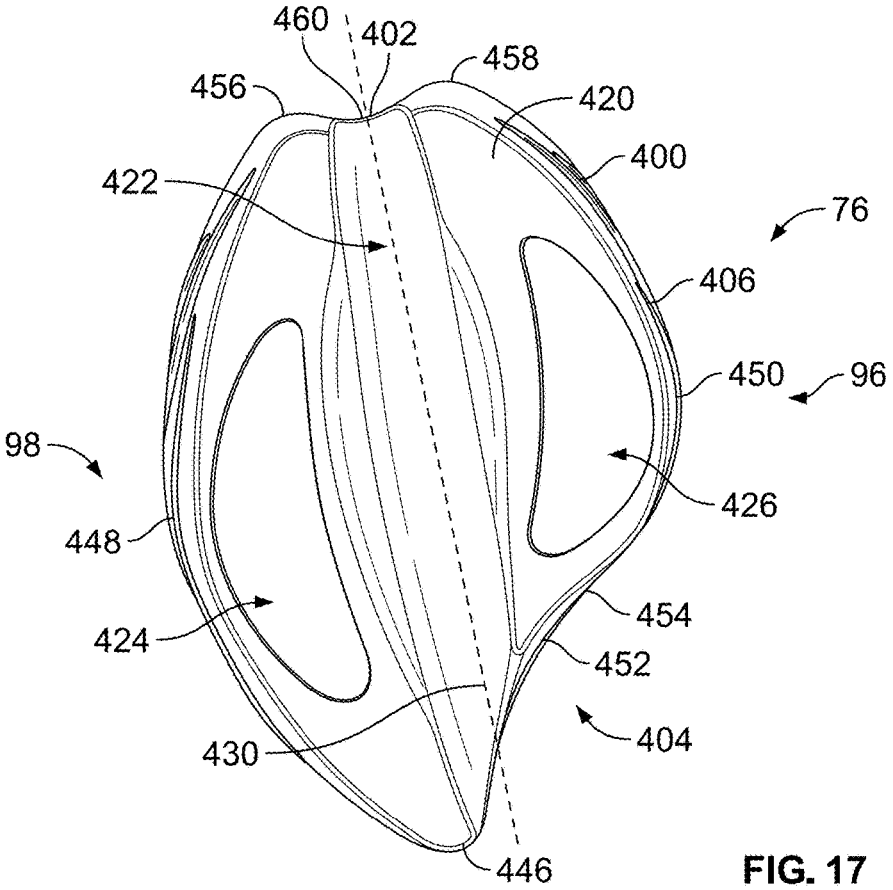
FIG. 17 is a bottom plan view of the rear midsole of FIG. 14.

FIG. 17 illustrates the underside 420 of the rear midsole 76. As previously mentioned, the underside 420 of the rear midsole 76 includes two recesses, i.e., the first recess 424 and the second recess 426. The first recess 424 and the second recess 426 are generally crescent shaped. The first recess 424 curves toward the lateral side 98 of the sole structure 64, and the second recess 426 curves toward the lateral side 98 of the sole structure 64. In some embodiments, the second recess 426 is more curved than the first recess 424, i.e., the radius of curvature defined by a medial side corner of the second recess 426 is smaller than the radius of curvature defined by a lateral side corner of the first recess 424. In some embodiments, the first recess 424 is longer than the second recess 426, wherein the length is a maximum distance measured linearly from a first corner of the indentation to a second corner of the indentation, wherein the first corner is the corner disposed closest to the front end 404 of the rear midsole 76 and the second corner is the corner disposed closest to the heel end 402 of the rear midsole 76. The first recess 424 is disposed between the gap 422 and the lateral side 98 of the rear midsole 76, and the second recess 426 is disposed between the gap 422 and the medial side 96 of the rear midsole 76. The first recess 424 and the second recess 426 do not extend all the way to the heel end 402 of the rear midsole 76 or all the way to the front end 404 of the rear midsole 76.

Figure 18:
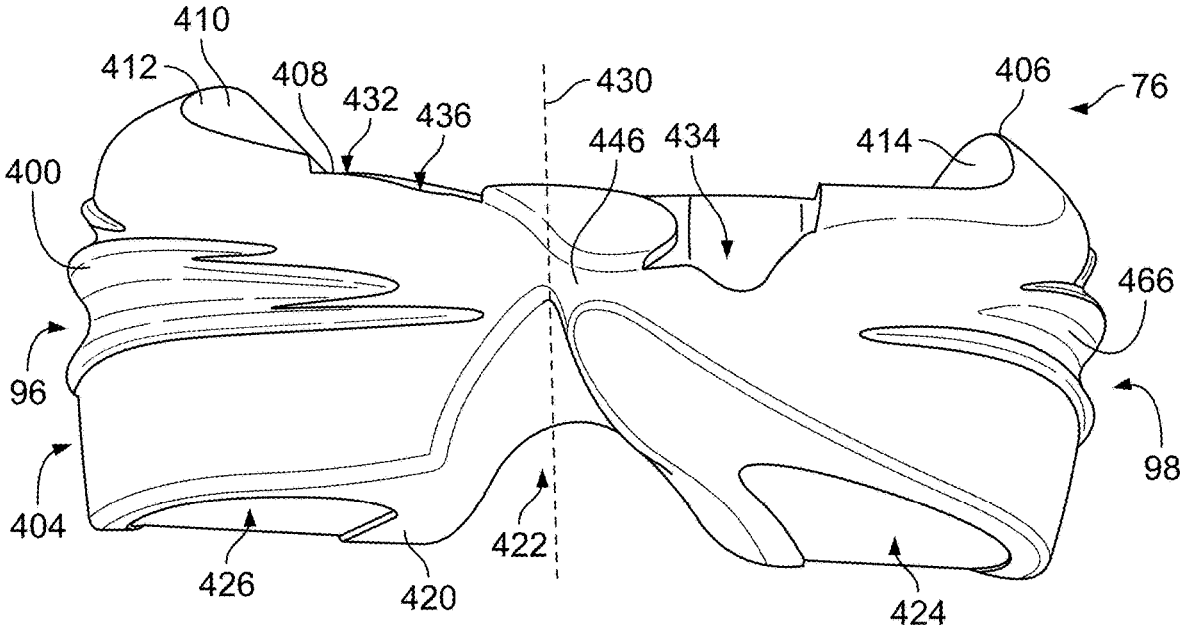
FIG. 18 is a front elevational view of the rear midsole of FIG. 14.
Figure 19:
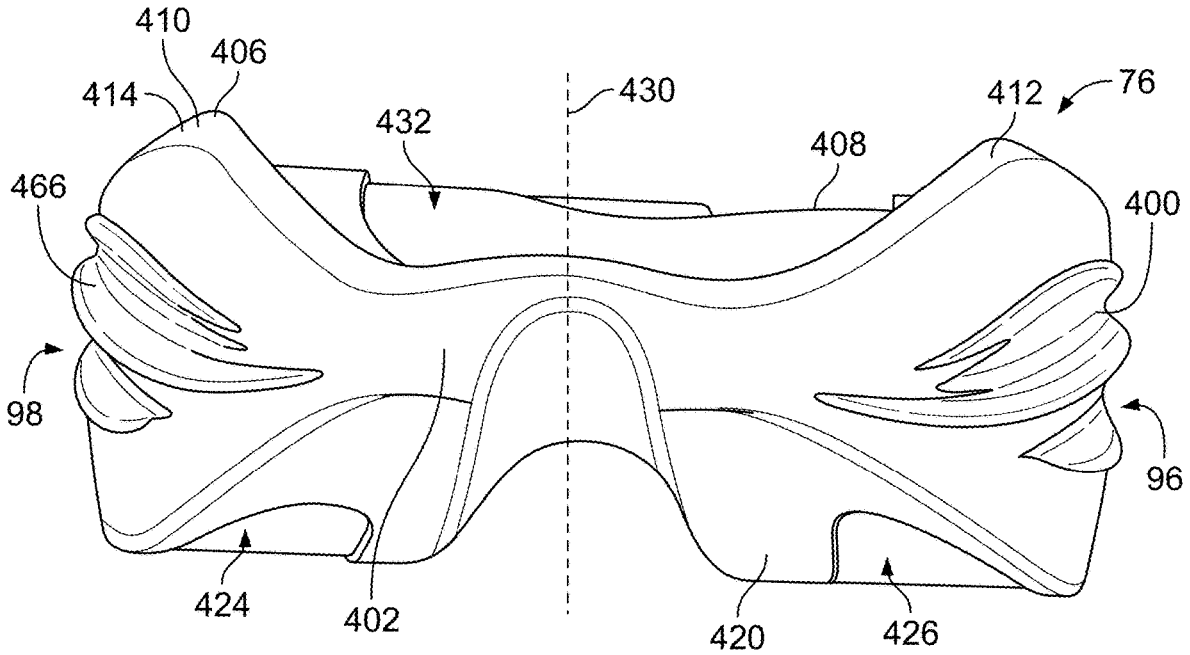
FIG. 19 is a rear elevational view of the rear midsole of FIG. 14.

Turning to FIG. 18, a front view of the rear midsole 76 is illustrated. As discussed previously, the medial side 96 of the rear midsole 76 includes the plurality of medial side ridges 400. Similarly, the lateral side 98 of the rear midsole 76 also includes a plurality of lateral side ridges 466. The plurality of medial side ridges 400 on the medial side 96 are substantially the same as the plurality of lateral side ridges 466 on the lateral side 98. However, in some embodiments, the medial side ridges 400 are different from the lateral side ridges 466. Further, in some embodiments, the lateral side ridges 466 and the medial side ridges 400 of the rear midsole 76 do not extend all the way to the front end 404 or the heel end 402 of the gap 422. The lip 410, the gap 422, the first recess 424, the second recess 426, the first recess 424 and the second recess 426 of the rear midsole 76 are illustrated in more detail as well. As previously mentioned, in some embodiments, the lip 410 of the rear midsole 76 curves inwards toward the central longitudinal plane 430 as it extends upward. FIG. 19 illustrates a rear view of the rear midsole 76. Similar to FIG. 18, FIG. 19 illustrates the medial side ridges 400, the lateral side ridges 466, the gap 422, the first recess 424, the second recess 426, the first depression 432, and the lip 410 of the rear midsole 76 in more detail.

Figure 20:
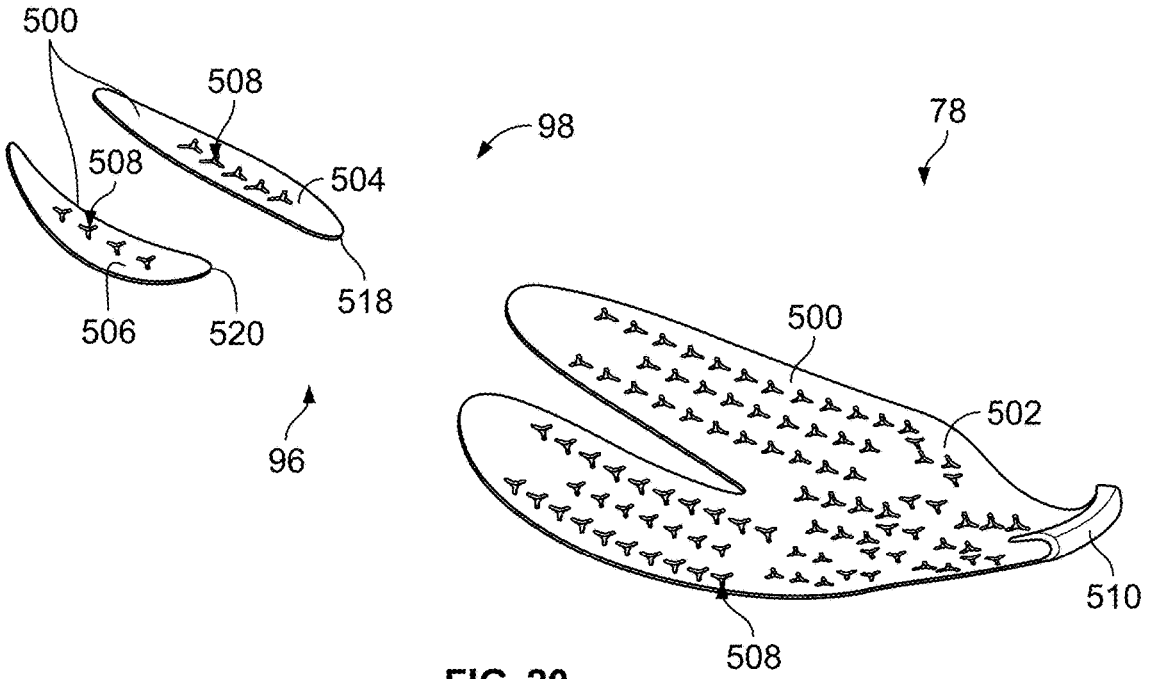
FIG. 20 is a top isometric view of the outsole of the sole structure of FIG. 2.

As shown in FIG. 20, the outsole 78 includes a plurality of sections 500. A first section 502 of the outsole 78, a second section 504 of the outsole 78, and a third section 506 of the outsole 78 are not directly coupled to one another. Each of the sections 500 includes a plurality of apertures 508. In some embodiments, the first section 502 of the outsole 78 is larger than the second section 504 of the outsole 78 and the third section 506 of the outsole 78. In some embodiments, the first section 502 of the outsole 78 includes more apertures than the second section 504 of the outsole 78 and the third section 506 of the outsole 78. A toe end 510 of the outsole 78 curves upward, and the top of the toe end 510 of the outsole 78 curves rearwards.

Still referring to FIG. 20, the apertures 508 on the first outsole section 502 are generally the same shape as the apertures 508 on the second outsole section 504 and the third outsole section 506. In some embodiments, the apertures 508 are a three-pronged shape. The apertures 508 are not evenly distributed throughout the sections 502, 504, 506. In some embodiments, the second outsole section 504 and the third outsole section 506 include a single row of apertures 508. The second outsole section 504 includes more apertures 508 than the third outsole section 506. The second outsole section 504 is larger than the third outsole section 506. A front end 518 of the second outsole section 504 is closer to the first outsole section 502 than a front end 520 of the third outsole section 506. The second outsole section 504 and the third outsole section 506 are generally crescent shapes.

Figure 21:
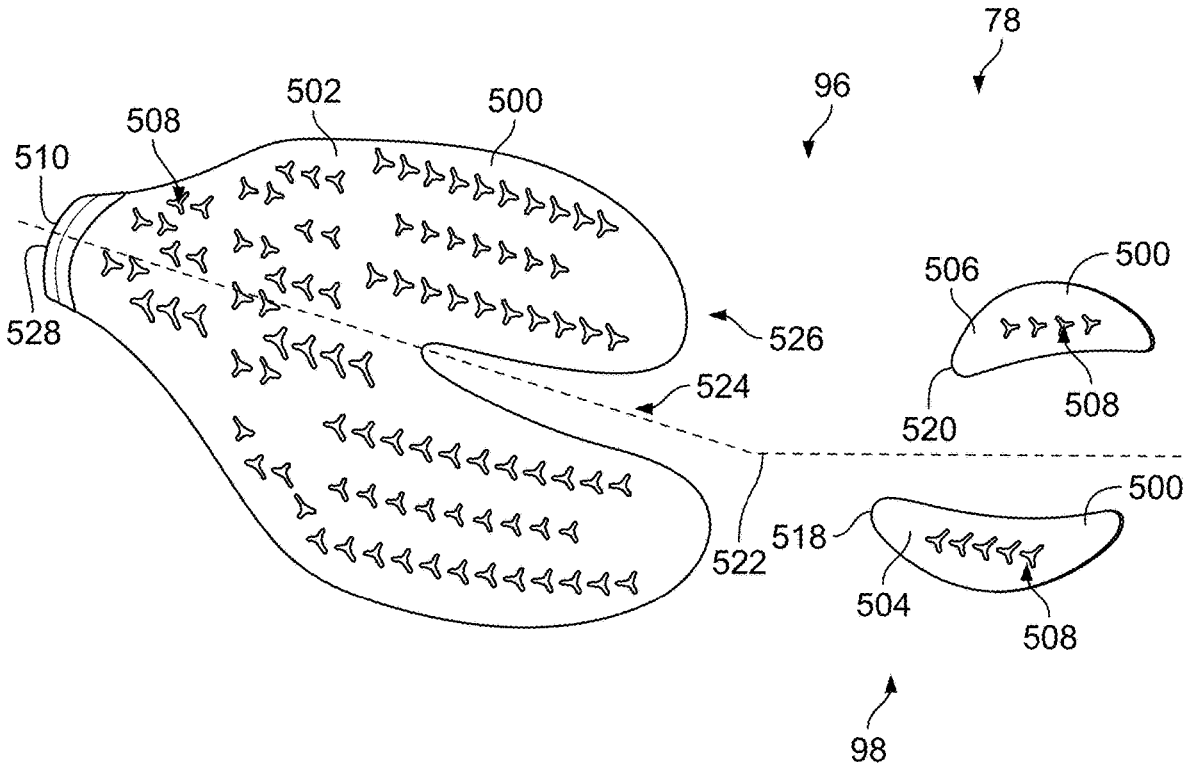
FIG. 21 is a top plan view of the outsole of FIG. 20.

FIG. 21 illustrates a bottom plan view of the outsole 78. The first outsole section 502, second outsole section 504, and third outsole section 506 are illustrated in more detail. Further, a central longitudinal plane 522 of the outsole 78 is illustrated. The second outsole section 504 is disposed entirely on the lateral side 98 of the central longitudinal plane 522, and the third outsole section 506 is disposed entirely on the medial side 96 of the central longitudinal plane 522. Further, the first section 502 of the outsole 78 includes a notch 524 that extend generally along a central longitudinal plane 522 of the outsole 78. The notch 524 of first section 502 extends from a rearward end 526 of the first section 502 toward a toe end 528 of the first section 502, which is the same as the toe end 510 of the outsole 78. The notch 524 does not extend entirely to the toe end 528 of the first section 502. The notch 524 is thicker toward the rear end 526 of the first section 502 and tapers down as it extends toward the toe end 528. In some embodiments, the notch 524 of the first section 502 of the outsole 78 is the same shape as the notch 326 of the front midsole 74.

Figure 22:
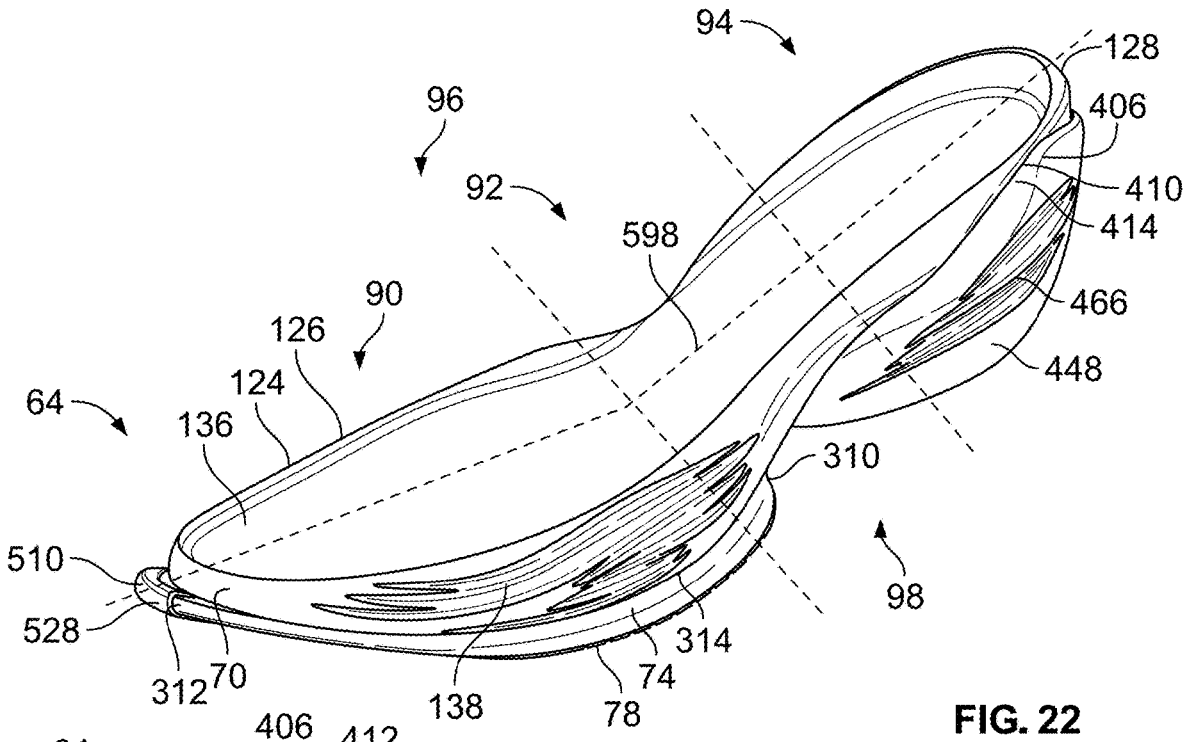
FIG. 22 is a top isometric view of the sole structure of FIG. 1 in an assembled configuration.

Referring now to FIG. 22 which depicts the entire sole structure 64, the top midsole 70 is positioned above the front midsole 74, and the toe end 312 of the front midsole 74 extends beyond the toe end 130 of the top midsole 70. Further, the front midsole 74 is positioned above the outsole 78, and the toe end 510 of the outsole 78 extends farther than the toe end 312 of the front midsole 74. Additionally, as previously mentioned, the toe end 510 of the outsole 78, which is the same as the toe end 528 of the first section 502 of the outsole 78, extends upward and rearward, resulting in the toe end 510 of the outsole 78 surrounding the toe end 312 of the front midsole 74. The top midsole 70 is positioned above the rear midsole 76. The lateral side 98 of the rear midsole 76 extends upward and surrounds some, but not all, of the lateral side 98 of the top midsole 70. More specifically, the lateral side depression 140 of the top midsole 70 receives the lateral side section 414 of the lip 410 of the rear midsole 76.

Figure 23:
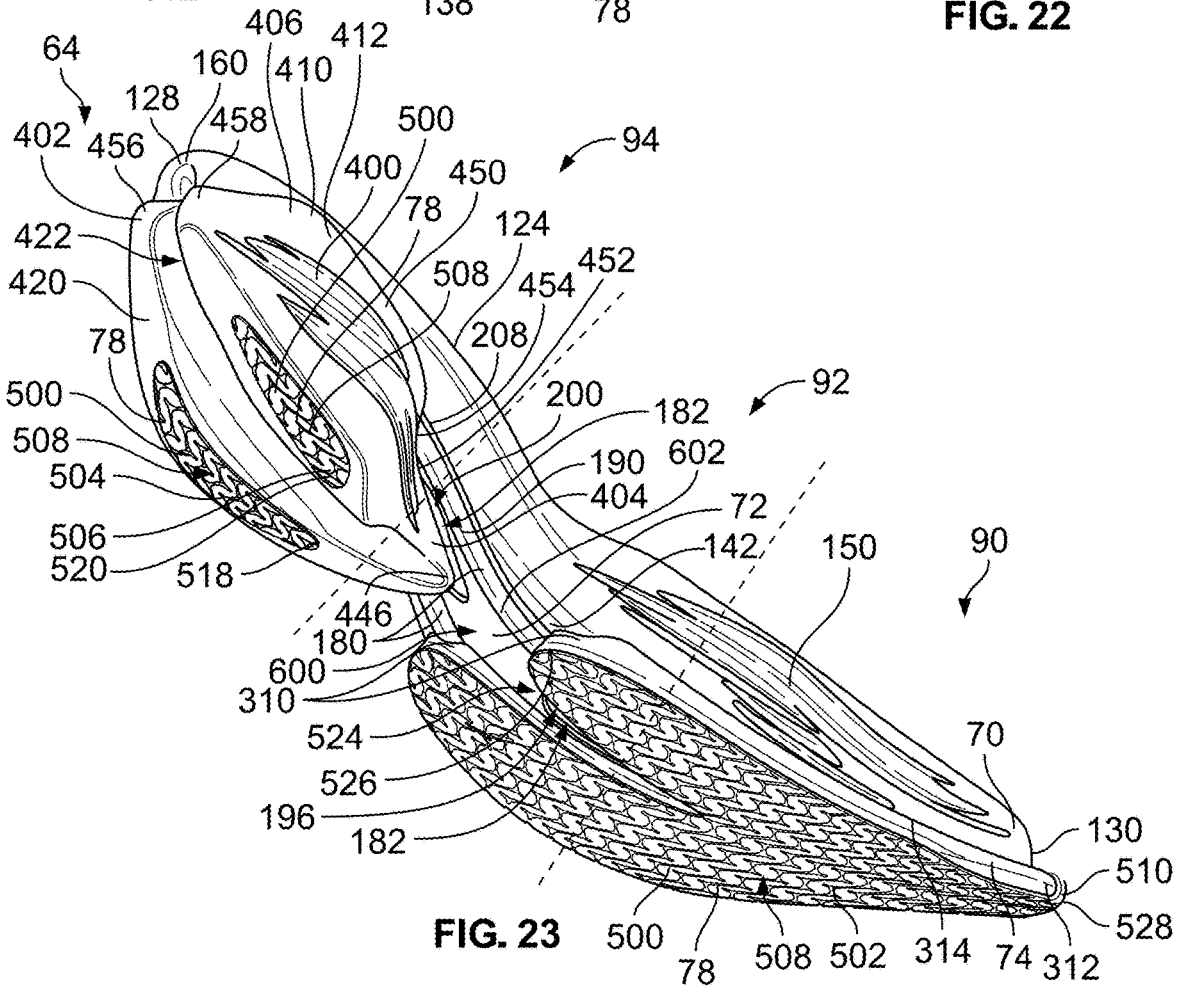
FIG. 23 is a bottom isometric view of the sole structure of FIG. 22.

As shown in FIG. 23, and as discussed above, the outsole 78 includes a plurality of sections 500. The sections 500 of the outsole 78 are directly coupled to the front midsole 74 and the rear midsole 76. More specifically, the first section 502 of the outsole 78 is coupled to the front midsole 74, and the second section 504 and the third section 506 of the outsole 78 are coupled to the rear midsole 76. The medial side 96 of the rear midsole 76, which is substantially the same as the lateral side 98 of the rear midsole 76, extends upward and surrounds some, but not all, of the medial side 96 of the top midsole 70. More specifically, a medial side depression of the top midsole 70 receives the medial side section 412 of the lip 410 of the rear midsole 76. Further, the upper side 408 of the heel end 402 of the rear midsole 76 and the underside 142 of the heel end 128 of the top midsole 70 are substantially aligned with each other. However, as mentioned previously, the upper side 136 of the heel end 128 of the top midsole 70 extends upward and outwards from the underside 142 of the heel end 128 of the top midsole 70. As such, the upper side 136 of the heel end 128 of the top midsole 70 is not aligned with the heel end 128 of the underside 142 of the top midsole 70 or the heel end 402 of the upper side 408 of the rear midsole 76.

With continued reference to FIG. 23, the sole plate 72 is directly coupled to the rear midsole 76 and the front midsole 74 and the front midsole 74 is spaced apart from the rear midsole 76, creating a void 600 between the front midsole 74 and the rear midsole 76. An underside 602 of the sole plate 72 is exposed in the void 600 between the front midsole 74 and the rear midsole 76.

Figure 24:
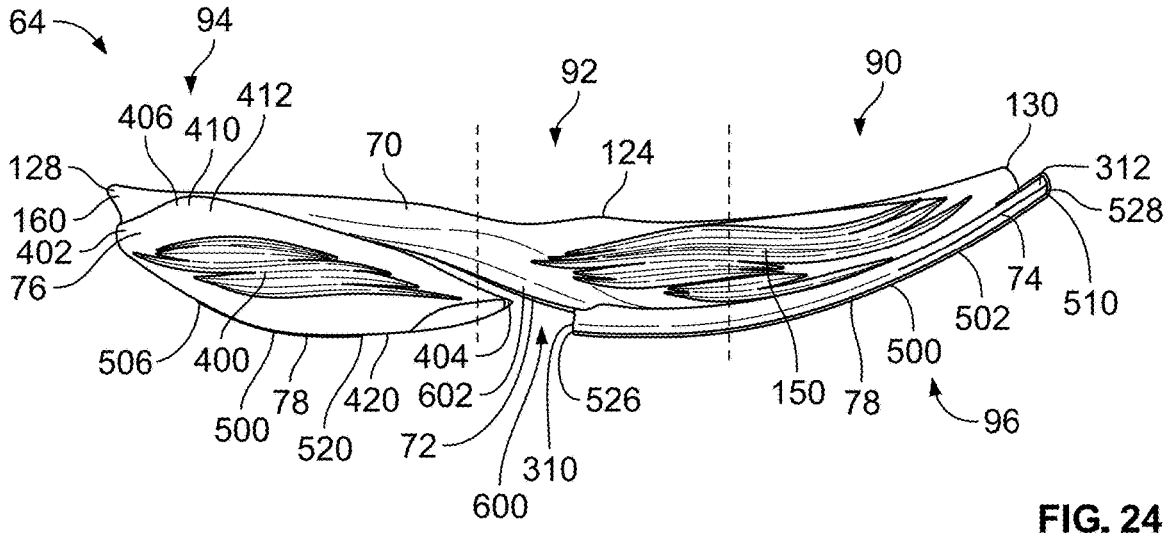
FIG. 24 is a medial side elevational view of the sole structure of FIG. 22.
Figure 25:
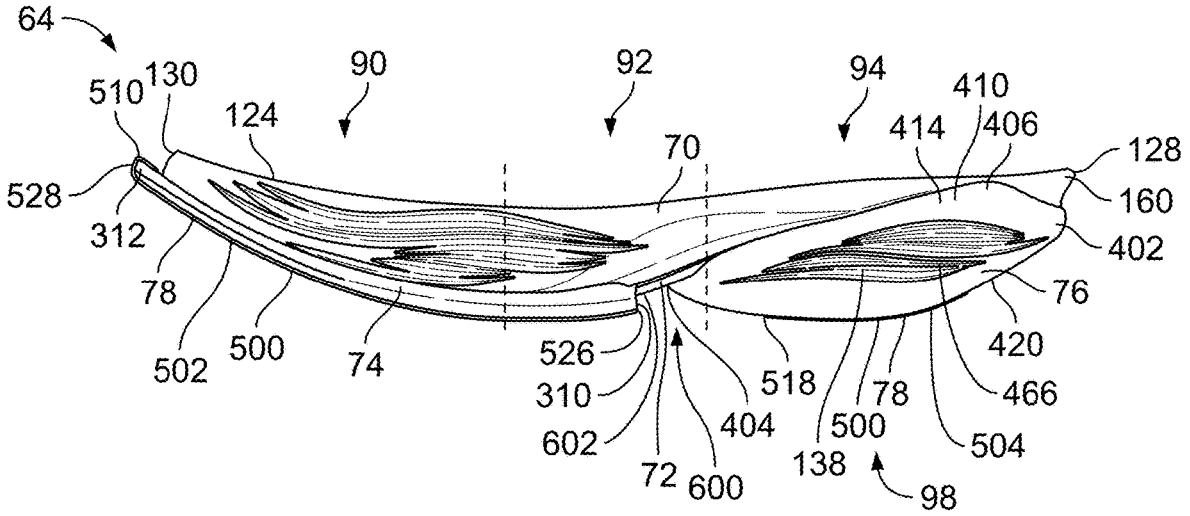
FIG. 25 is a lateral side elevational view of the sole structure of FIG. 22.

FIG. 24 further illustrates the medial side 96 of the sole structure 64. The ridges 150 of the top midsole 70 and the medial side ridges 400 of the rear midsole 76 are shown in more detail. Further, the toe end 510 of the outsole 78 is shown surrounding the toe end 312 of the front midsole 74. The outsole 78 is shown interfacing with the front midsole 74 and the rear midsole 76, and the sole plate 72 extends between the front midsole 74 and the rear midsole 76. Similar to FIG. 24, FIG. 25 illustrates the lateral side 98 of the sole structure 64. The lateral side 98 of the sole structure 64 is substantially the same as the medial side 96 of the sole structure 64.

Figure 26:
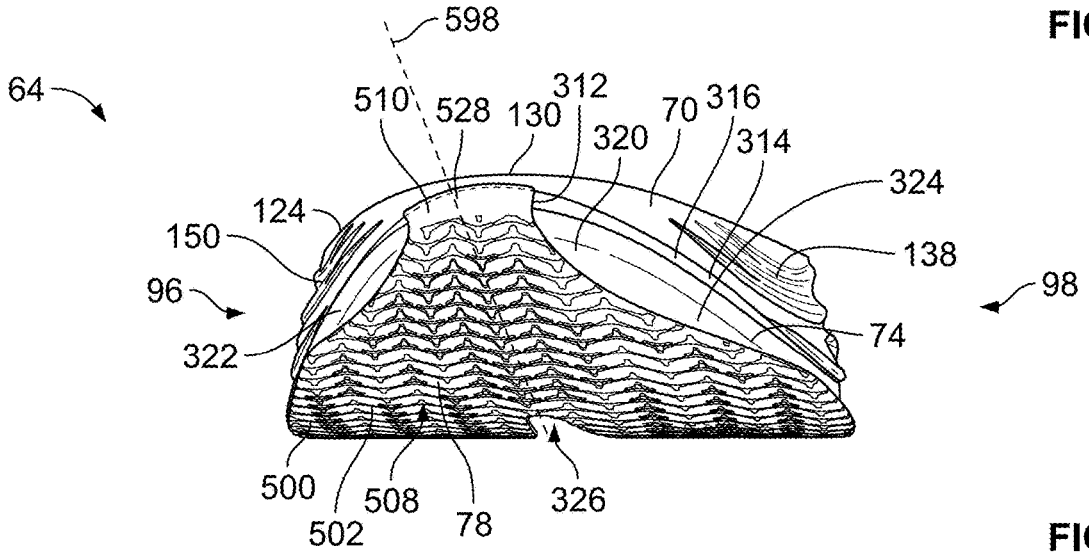
FIG. 26 is a front elevational view of the sole structure of FIG. 22.

Referring to FIG. 26, a front elevational view of the sole structure 64 is illustrated. An outer portion of the front midsole 74 is directly coupled to the underside 142 of the top midsole 70. Further, as mentioned previously, the first section 502 of the outsole 78 is coupled to the underside 320 of the front midsole 74. In some embodiments, the first section 502 of the outsole 78 does not cover the medial side section 322 and the lateral side section 324 of the front midsole 74. In some embodiments, the front midsole 74 includes two exposed sections. In some embodiments, the sections 322, 324 of the front midsole 74 are disposed toward the toe end 312 of the front midsole 74. The exposed sections 322, 324 of the front midsole 74 are disposed on the medial side 96 and the lateral side 98 of the front midsole 74, respectively.

Figure 27:
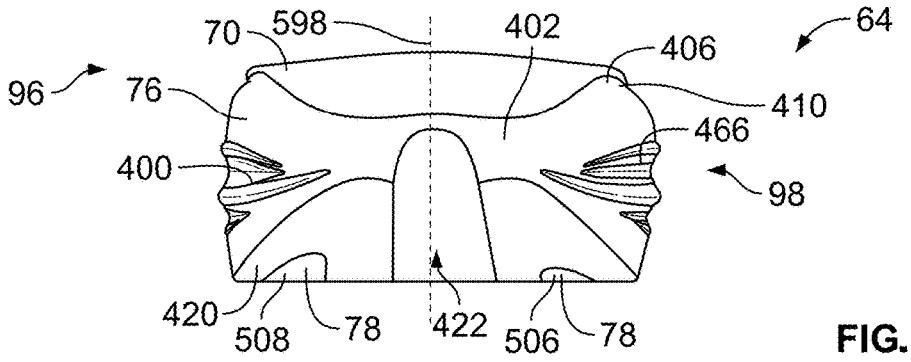
FIG. 27 is a rear elevational view of the sole structure of FIG. 22.

Turning to FIG. 27, the top midsole 70 is directly coupled to the rear midsole 76. As previously discussed, the second outsole section 504 and the third outsole section 506 are directly coupled to the underside 420 of the rear midsole 76. In some embodiments, the second section 504 of the outsole 78 is disposed between the gap 422 and the lateral side 98 of the rear midsole 76, and the third section 506 of the outsole 78 is disposed between the gap 422 and the medial side 96 of the rear midsole 76. The second section 504 of the outsole 78 and the third section 506 of the outsole 78 do not cover all of the underside 420 of the rear midsole 76. The second section 504 of the outsole 78 and the third section 506 of the outsole 78 do not extend all the way to the heel end 402 of the rear midsole 76. In some embodiments, the first recess 424 of the rear midsole 76 receives the second section 504 of the outsole 78, and the second recess 426 of the rear midsole 76 receives the third section 506 of the outsole 78. In some embodiments, at some points in the heel region 94, the width of the top midsole 70 is smaller than the width of the rear midsole 76.

Figure 28:
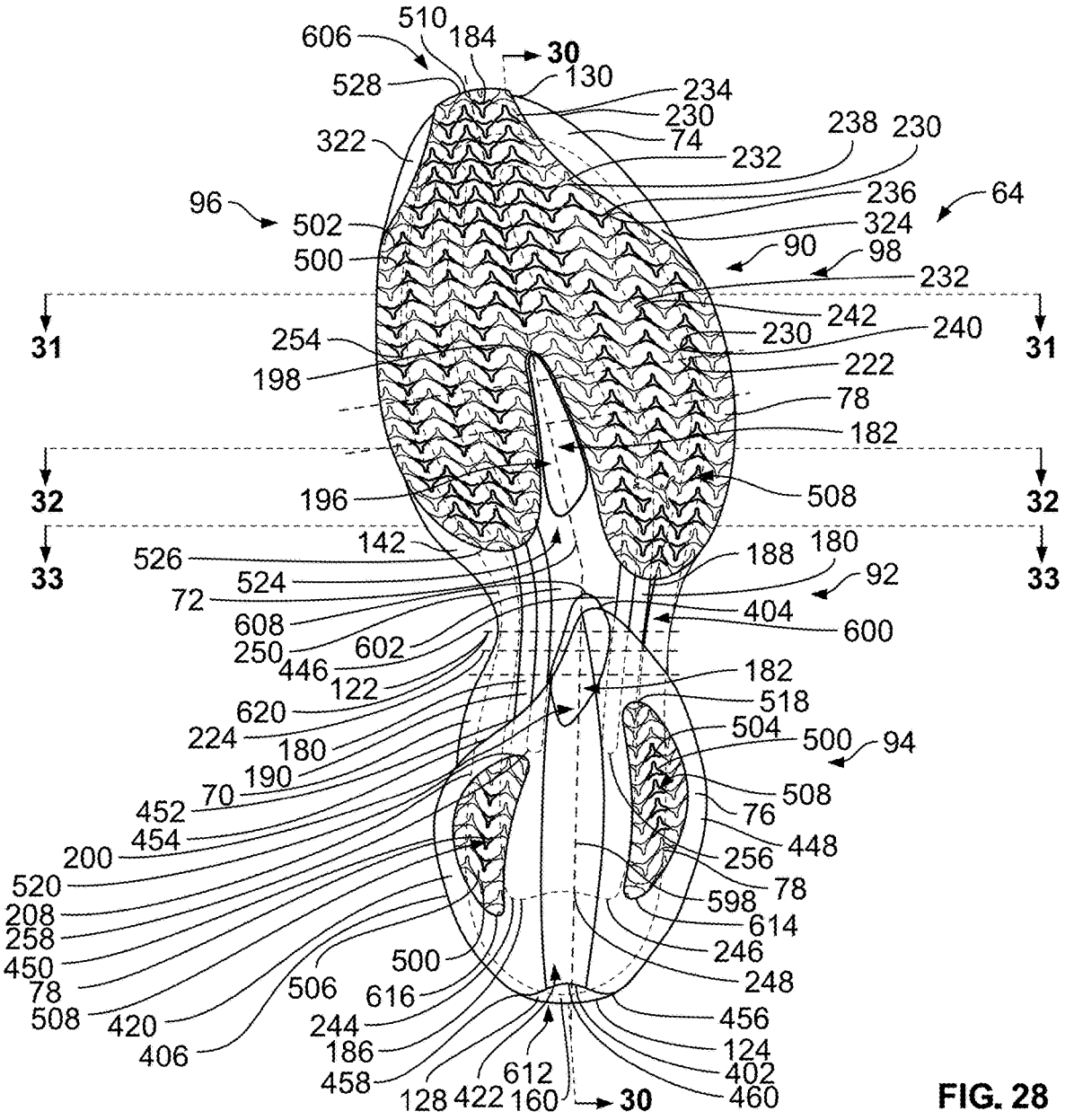
FIG. 28 is a bottom plan view of the sole structure of FIG. 22.

Referring now to FIG. 28, the notch 326 of the front midsole 74 is the same as the notch 524 of the first section 502 of the outsole 78. Moreover, apart from the exposed sections 322, 324 of the front midsole 74, the first section 502 of the outsole 78 and the front midsole 74 have substantially the same profile. Still referring to FIG. 28, the sole plate 72 is disposed in the forefoot region 90, the midfoot region 92, and the heel region 94 of the sole structure 64. The first aperture 196 of the sole plate 72 is disposed entirely within and has the same shape as the notch 524 of the first section 502 of the outsole 78 and the notch 326 of the front midsole 74. The first aperture 196 of the sole plate 72 exposes the underside 142 of the top midsole 70. In some embodiments, the second aperture 200 of the sole plate 72 is disposed near the point 446 of the rear midsole 76.

In some embodiments, the second aperture 200 of the sole plate 72 is disposed entirely within the point 446 of the rear midsole 76. In some embodiments, the second aperture 200 of the sole plate 72 is disposed partially within the point 446 of the rear midsole 76. In some embodiments, the second aperture 200 of the sole plate 72 is not disposed within the point 446 of the rear midsole 76 at all. The second aperture 200 is disposed closer to a toe end 606 of the sole structure 64 than any portion of the second section 504 of the outsole 78 and any portion of the third section 506 of the outsole 78. A forwardmost end 608 of the second aperture 200 of the sole plate 72 is disposed closer to the toe end 606 of the sole structure 64 than a forwardmost end of the point 446 of the rear midsole 76. The heel end 186 of the sole plate 72 extends generally as far toward a heel end 612 of the sole structure 64 as a heel end 614 of the second section 504 of the outsole 78 and a heel end 616 of the third section 506 of the outsole 78. The toe end 184 of the sole plate 72 does not extend all the way to the toe end 510 of the outsole 78. To that end, the toe end 184 of the sole plate 72 does not extend as far as the toe end 528 of the first section 502 of the outsole 78, and the toe end 312 of the front midsole 74. The underside 602 of the sole plate 72 is exposed between the rear end 310 of the front midsole 74 and the front end of the rear midsole 76.

With continued reference to FIG. 28, the top midsole 70 is disposed within the forefoot region 90, the midfoot region 92, and the heel region 94 of the sole structure 64. The second top midsole line 122 defines a narrowest section 620 of the sole structure 64. The narrowest section 620 of the sole structure 64 is disposed within the midfoot region 92. In some embodiments, the top midsole 70 is generally the same shape as the front midsole 74 in the forefoot region 90, except for the notch 326 of the front midsole 74. In the midfoot region 92, the top midsole 70 generally defines the profile of the sole structure 64. To this end, the top midsole 70 is wider than the sole plate 72 in the midfoot region 92.

At some points along where the top midsole 70 is coupled to the rear midsole 76, the top midsole 70 is also wider than the rear midsole 76. At such points, the top midsole 70 defines the profile of the sole structure 64. At other points along where the top midsole 70 is coupled to the rear midsole 76, the rear midsole 76 is wider than the top midsole 70, and the top midsole 70 does not define the profile of the sole structure 64 at those points. Accordingly, the top midsole 70 does not define the profile of the sole structure 64 throughout the entirety of the heel region 94. Further, the top midsole 70 does not define the profile of the sole structure 64 throughout the entirety of the region between the narrowest section 620 of the sole structure 64 and the heel end 612 of the sole structure 64.

Still referring to FIG. 28, the second section 504 of the outsole 78 is directly coupled to the rear midsole 76. The second section 504 of the outsole 78 is disposed on the lateral side 98 of the sole structure 64 and is disposed primarily in the heel region 94 of the sole structure 64. In some embodiments, the second section 504 of the outsole 78 is disposed between the narrowest section 620 of the sole structure 64 and the heel end 612 of the sole structure 64. The third section 506 of the outsole 78 is also directly coupled to the rear midsole 76. Further, the third section 506 of the outsole 78 is disposed primarily on the medial side 96 of the sole structure 64, and in the heel region 94 of the sole structure 64. In some embodiments, the third section 506 of the outsole 78 is disposed between the narrowest section 620 of the sole structure 64 and the heel end 612 of the sole structure 64. The first recess 424 of the rear midsole 76 receives the second section 504 of the outsole 78 and the second recess 426 of the rear midsole 76 receives the third section 506 of the outsole 78. To that end, the first recess 424 of the rear midsole 76 and the second section 504 of the outsole 78 are substantially the same shape. Similarly, the second recess 426 of the rear midsole 76 and the third section 506 of outsole 78 are substantially the same shape.

As shown in FIG. 28, the third section 506 of the outsole 78 generally follows the convex curve 450 of the medial side 96 of the rear midsole 76. Further, in some embodiments, the third section 506 of the outsole 78 is disposed entirely rearward of the point of inflection 454 of the medial side 96 of the rear midsole 76.

Figures 29, 30:
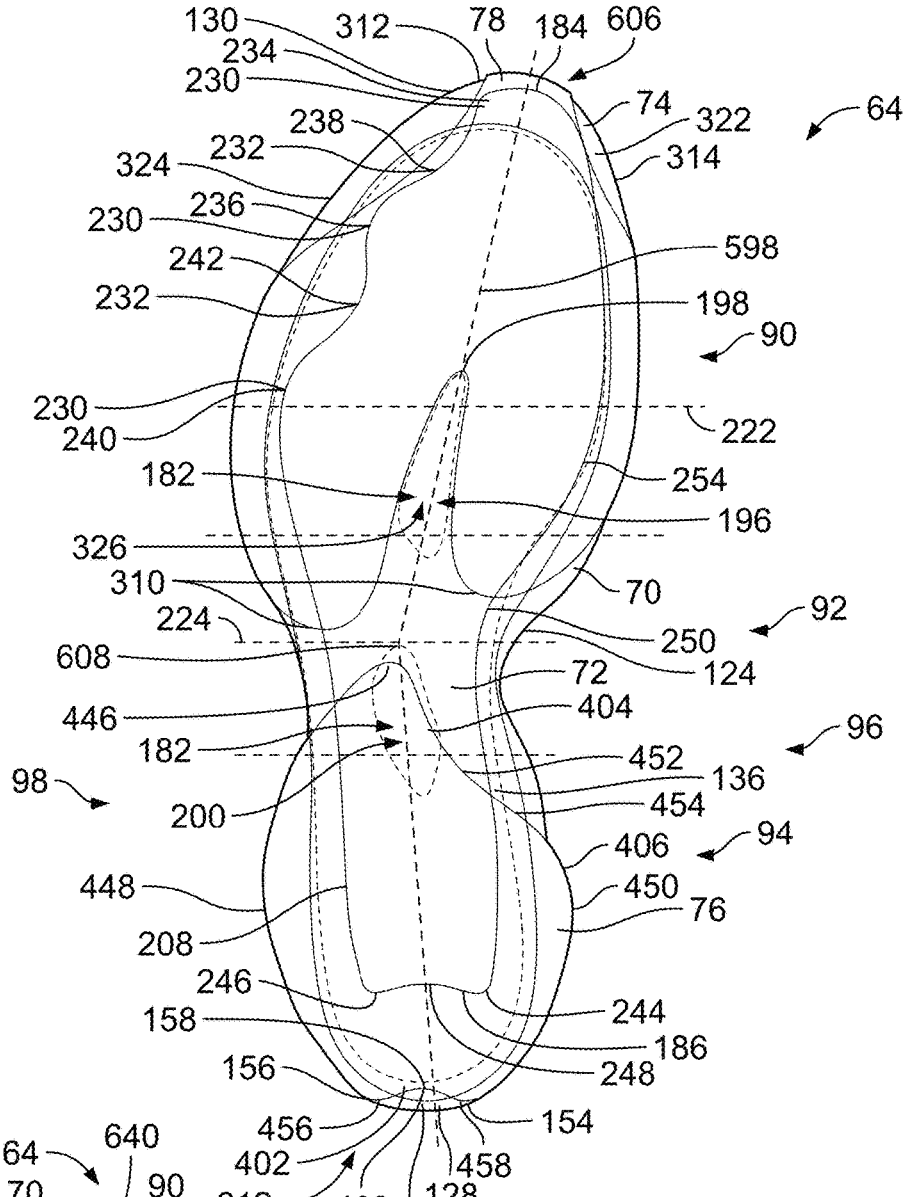
FIG. 29 is a top plan view of the sole structure of FIG. 22.
FIG. 30 is a side cross-sectional view of the sole structure taken through line 30-30 of FIG. 28.

Referring now to FIG. 29, a profile of the upper side 136 of the top midsole 70 is illustrated. As discussed previously, the top midsole 70 has the same outer profile as the front midsole 74 in the forefoot region 90. The top midsole 70 is the widest component in portions of the midfoot region 92, resulting in the top midsole 70 defining the profile of the sole structure 64 at said portions. At some points, the rear midsole 76 is wider than the top midsole 70. At those points, the rear midsole 76 defines the profile of the sole structure 64. In some embodiments, most of the profile of the sole structure 64 between the narrowest section 620 of the sole structure 64 and the heel end 612 of the sole structure 64 is defined by the rear midsole 76. Finally, as discussed above, the profile of the upper side 136 of the top midsole 70 is disposed closer to a central longitudinal plane 598 of the sole structure 64 than a profile of the underside 142 of the top midsole 70.

FIG. 30 illustrates a side cross-sectional view of the sole structure 64 along the central longitudinal plane 598, i.e., along line 30-30 of FIG. 28. As discussed previously, the upper 62 is directly coupled to the upper side 136 of the top midsole 70. The lip 126 of the top midsole 70 surrounds a toe end 640 of the upper 62 and a heel end 642 of the upper 62. The sole plate 72 is shown coupled to the underside 142 of the top midsole 70. The toe end 184 of the sole plate 72 extends past the toe end 130 of the top midsole 70. The heel end 186 of the sole plate 72 does not extend as far as the heel end 128 of the top midsole 70. Further, the toe end 312 of the front midsole 74 extends farther than the toe end 184 of the sole plate 72 and the toe end 130 of the top midsole 70. Finally, the toe end 528 of the first section 502 of the outsole 78 extends farther than the toe end 312 of the front midsole 74, the toe end 184 of the sole plate 72, and the toe end 130 of the top midsole 70. Additionally, the sole plate 72 is disposed substantially within the front midsole 74 in the forefoot region 90, and the sole plate 72 is disposed substantially within the rear midsole 76 in the heel region 94. Accordingly, the first depression 304 of the front midsole 74 receives the sole plate 72, and the first depression 432 of the rear midsole 76 receives the sole plate 72.

Figure 31:
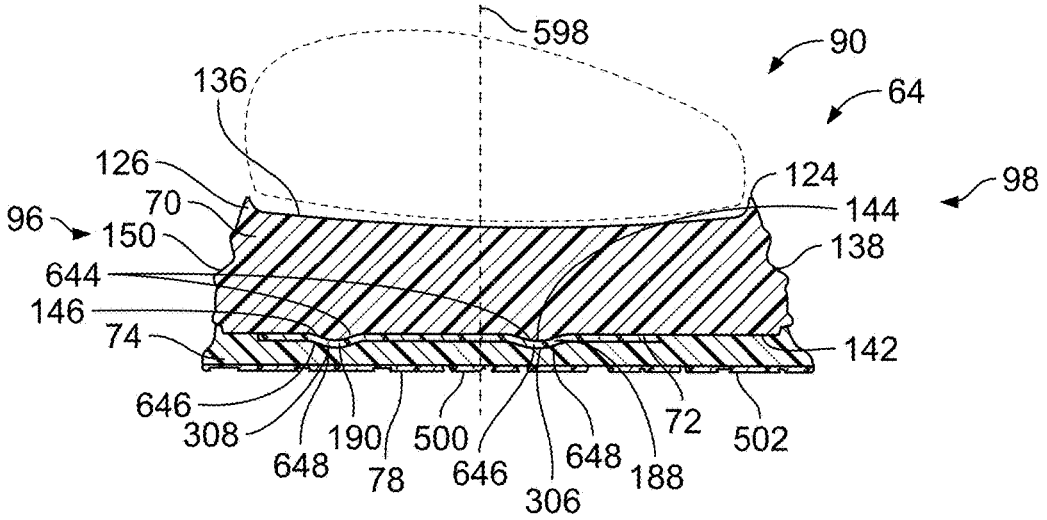
FIG. 31 is a rear cross-sectional view of the sole structure taken through line 31-31 of FIG. 28.

FIG. 31 illustrates a rear cross-sectional view of the sole structure 64 in the forefoot region 90. Along the line 31-31 of FIG. 28, the sole plate 72 is disposed substantially within the front midsole 74. In some embodiments, the sole plate 72 is disposed off-center toward the medial side 96 of the sole structure 64. The top midsole 70 is generally flat but includes the first rib 144 and the second rib 146 that result in a plurality of top midsole curved sections 644. Similarly, the sole plate 72 is generally flat, and the sole structure 64 includes the plurality of ribs 180 that result in a plurality of sole plate curved sections 646. To that end, the first rib 188 of the sole plate 72 receives the first rib 144 of the top midsole 70, and the second rib 190 of the sole plate 72 receives the second rib 146 of the top midsole 70. Additionally, not illustrated, the third rib 204 of the sole plate 72 receives the third rib 148 of the top midsole 70. Moreover, the second depression 306 of the front midsole 74 and the third depression 308 of the front midsole 74 create a plurality of front midsole curved sections 648 that align with the sole plate curved sections 646 of the sole plate 72 and the top midsole curved sections 644 of the top midsole 70. Accordingly, the second depression 306 of the front midsole 74 receives the first rib 188 of the sole plate 72, and the third depression 308 of the front midsole 74 receives the second rib 190 of the sole plate 72. The top midsole 70, the front midsole 74, and the first section 502 of the outsole 78 extend from the medial side 96 to the lateral side 98 of the sole structure 64.

Figure 32:
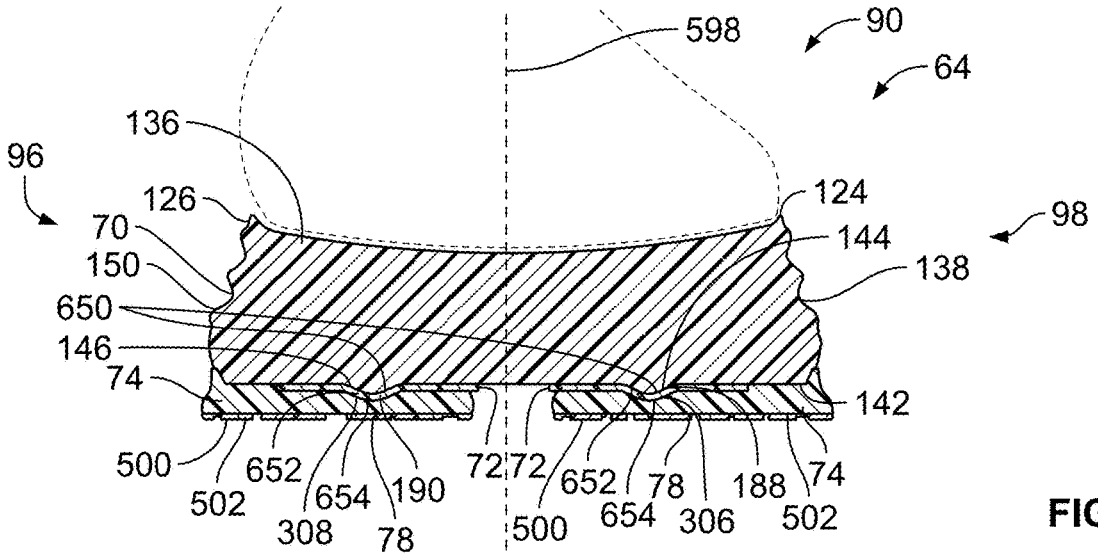
FIG. 32 is a rear cross-sectional view of the sole structure taken through line 32-32 of FIG. 28.

FIG. 32 illustrates another rear cross-sectional view of the sole structure 64 in the forefoot region 90. Along the line 32-32 of FIG. 28, the top midsole 70 extends from the medial side 96 to the lateral side 98. The sole plate 72 is disposed within the front midsole 74. The top midsole 70 is generally flat but includes the first rib 144 and the second rib 146 that result in a plurality of top midsole curved sections 650. Similarly, the sole plate 72 is generally flat, but includes a plurality of sole plate curved sections 652 formed by the first rib 188 and the second rib 190 of the sole plate 72. Also, the front midsole 74 is generally flat, but includes a plurality of front midsole curved sections 654 formed by the second depression 306 and the third depression 308. The sole plate 72 and the front midsole 74 are discontinuous along the central longitudinal plane 598 of the sole structure 64. A depth of the plurality of top midsole ribs 144, 146 of the top midsole 70 along line 32-32 of FIG. 28 is larger than a depth of the plurality of top midsole ribs 144, 146 of the top midsole 70 along line 31-31 of FIG. 28. As a result, the plurality of top midsole curved sections 650 of the top midsole 70 caused by the plurality of top midsole ribs 144, 146 along line 32-32 has a smaller radius of curvature than the plurality of top midsole curved sections 644 of the top midsole 70 along line 31-31 (see FIG. 31). Accordingly, a depth of the plurality of sole plate ribs 180 along line 32-32 of FIG. 28 is larger than a depth of the plurality of sole plate ribs 180 along line 31-31 of FIG. 28. Similarly, a depth of the plurality of front midsole depressions 306, 308 along line 32-32 of FIG. 28 is larger than a depth of the plurality of front midsole depressions 306, 308 along line 31-31 of FIG. 28. To that end, the plurality of sole plate curved sections 652 of the sole plate 72 and the plurality of front midsole curved sections 654 of the front midsole 74 along line 32-32 of FIG. 28 define a smaller radius of curvature than the plurality of sole plate curved sections 646 of the sole plate 72 and the plurality of front midsole curved sections 648 of the front midsole 74 along line 31-31 (see FIG. 31).

Still referring to FIG. 32, the sole plate 72 is substantially centered within the front midsole 74 along line 32-32. The front midsole 74 is discontinuous along the central longitudinal plane 598, and the outsole 78 is discontinuous along the central longitudinal plane 598. The underside 142 of the top midsole 70 30 is the bottom-most surface of the sole structure 64 at some points along the line 32-32 of FIG. 28.

Figure 33:
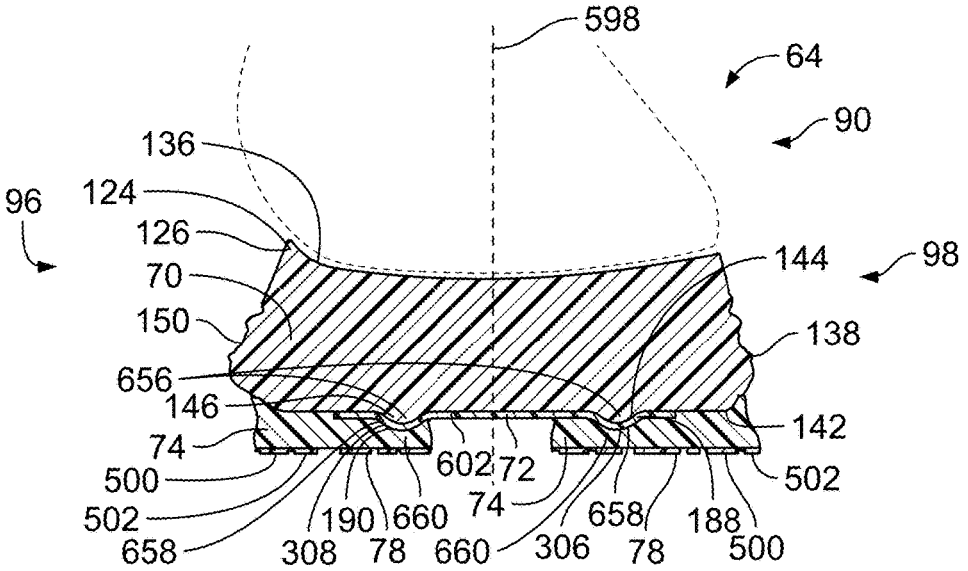
FIG. 33 is a rear cross-sectional view of the sole structure taken through line 33-33 of FIG. 28.

FIG. 33 illustrates a rear cross-sectional view of the sole structure 64 in the midfoot region 92. Along the line 33-33 of FIG. 28, the top midsole 70 extends from the medial side 96 to the lateral side 98. The sole plate 72 is substantially disposed within the front midsole 74. The top midsole 70, the sole plate 72, and the front midsole 74 are generally flat. A depth of the plurality of top midsole ribs 144, 146, a depth of the plurality of sole plate ribs 180, and a depth of the plurality of front midsole depressions 306, 308 along line 33-33 of FIG. 28 is larger than the depth of the plurality of top midsole ribs 144, 146, the depth of the plurality of sole plate ribs 180, and the depth of the plurality of front midsole depressions 306, 308 along line 32-32 and the depth of the plurality of top midsole ribs 144, 146, the depth of the plurality of sole plate ribs 180, and the depth of the plurality of front midsole depressions 306, 308 along line 31-31 respectively. As a result, a plurality of top midsole curved sections 656 caused by the plurality of top midsole ribs 144, 146 along line 33-33 has a smaller radius of curvature than the plurality of top midsole curved sections 650 along line 32-32 (see FIG. 32) and the plurality of top midsole curved sections 644 along line 31-31 (see FIG. 31). Similarly, a plurality of sole plate curved sections 658 caused by the plurality of sole plate ribs 180 along line 33-33 has a smaller radius of curvature than the plurality of sole plate curved sections 652 along line 32-32 (see FIG. 32) and the plurality of sole plate curved sections 646 along line 31-31 (see FIG. 31). Finally, a plurality of front midsole curved sections 660 caused by the plurality of front midsole depressions 306, 308 along line 33-33 has a smaller radius of curvature than the plurality of front midsole curved sections 654 along line 32-32 (see FIG. 32) and the plurality of front midsole curved sections 648 along line 31-31 (see FIG. 31).

Still referring to FIG. 33, the sole plate 72 is substantially centered within the front midsole 74 along line 33-33. The front midsole 74 is discontinuous along the central longitudinal plane 598 of the sole structure 64. The outsole 78 is discontinuous along the central longitudinal plane 598 of the sole structure 64. Because the front midsole 74 and the outsole 78 are discontinuous along the central longitudinal plane 598, the underside 602 of the sole plate 72 is the bottom plane of the sole structure 64 along the central longitudinal plane 598 of the sole structure 64.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the disclosure. The exclusive rights to all modifications which come within the scope of the appended claims are reserved.

We claim:

1. An article of footwear defining a lateral side and a medial side, the article of footwear comprising:

an upper; and a sole structure that defines a widest section, a narrowest section, a toe end, and a heel end, the sole structure comprising:

a first midsole that is directly coupled to the upper, a sole plate that is directly coupled to the first midsole, a second midsole that is directly coupled to the first midsole and the sole plate and disposed between the toe end of the sole structure and the widest section of the sole structure, and an outsole that defines a ground-engaging surface and is directly coupled to the second midsole, wherein a toe end of the outsole extends beyond a toe end of the second midsole, wherein the toe end of the second midsole surrounds a toe end of the sole plate, and wherein the toe end of the sole plate, the toe end of the second midsole, and the toe end of the outsole extend beyond a toe end of the first midsole.

2. The article of footwear of claim 1, wherein the sole plate comprises a carbon fiber material.

3. The article of footwear of claim 1, wherein the upper has a plain knit structure.

4. The article of footwear of claim 1, wherein a sidewall of the first midsole includes at least one ridge.

5. The article of footwear of claim 1, wherein at least one of the first midsole and the second midsole comprise a micropore foam.

6. The article of footwear of claim 1, wherein the sole plate includes a curved portion and a rear portion, wherein the curved portion is an anterior curved portion and defines one or more radii of curvature, and wherein the rear portion is relatively flat.

7. An article of footwear defining a lateral side and a medial side, the article of footwear comprising:

an upper; and a sole structure that defines a widest section, a narrowest section, a toe end, and a heel end, the sole structure comprising:

a first midsole that includes a foot-facing side and a ground-facing side, a sole plate that includes a foot-facing side and a ground-facing side, wherein the foot-facing side of the sole plate contacts the ground-facing side of the first midsole, a second midsole that includes a foot-facing side and a ground-facing side, wherein the foot-facing side of the second midsole contacts the ground-facing side of the sole plate, and an outsole that includes a foot-facing side and a ground-facing side, wherein the foot-facing side of the outsole contacts the ground-facing side of the second midsole and the ground-facing side of the outsole defines a ground-engaging surface, wherein a toe end of the second midsole surrounds a toe end of the sole plate, and wherein the toe end of the sole plate and the toe end of the second midsole extend beyond a toe end of the first midsole.

8. The article of footwear of claim 7, wherein an outer edge of the foot-facing side of the first midsole includes a lip, and wherein the lip is configured to contact the upper.

9. The article of footwear of claim 7, wherein at least one of the first midsole and the second midsole comprises a micropore foam, wherein the sole plate comprises a carbon fiber material, and wherein the upper comprises a plain knit material.

10. The article of footwear of claim 7, wherein the outsole includes a plurality of sections that are spaced apart from one another.

11. The article of footwear of claim 10, wherein a first section of the plurality of sections of the outsole includes a notch.

12. The article of footwear of claim 7, wherein a heel end of the first midsole extends beyond a heel end of the sole plate, and wherein a heel end of the first midsole extends beyond a heel end of the outsole.

13. The article of footwear of claim 7, wherein the first midsole and the second midsole are visible when the article of footwear is viewed from a lateral side thereof.

14. An article of footwear having a forefoot region, a heel region, a midfoot region extending between the forefoot region and the heel region, a toe end in the forefoot region, a heel end in the heel region, a lateral side, and a medial side, the article of footwear comprising:

an upper; and a sole structure defining a widest section and a narrowest section, and comprising:

a first midsole that extends through the forefoot region, the midfoot region, and the heel region;

a sole plate that is disposed below the first midsole and extends through the forefoot region;

a second midsole that is disposed below the sole plate; and an outsole disposed below the sole plate, wherein a toe end of the second midsole surrounds a toe end of the sole plate, wherein a toe end of the sole plate extends beyond a toe end of the first midsole, and wherein a toe end of the outsole extends beyond the toe end of the first midsole.

15. The article of footwear of claim 14, wherein a toe end of the outsole extends beyond the toe end of the sole plate.

16. The article of footwear of claim 15, wherein the toe end of the outsole curves upward and a top end of the toe end of the outsole curves rearward, such that the toe end of the outsole defines the toe end of the article of footwear.

17. The article of footwear of claim 16, wherein the top end of the toe end of the outsole contacts the sole plate.

18. The article of footwear of claim 14, wherein a sidewall of the first midsole includes at least one ridge.

19. The article of footwear of claim 18, wherein the at least one ridge of the first midsole is at least partially disposed between the widest section and the heel end of the sole structure.

20. The article of footwear of claim 14, wherein a heel end of the first midsole is configured to extend beyond a heel end of the upper.

21. The article of footwear of claim 14, wherein the sole plate includes a first aperture and a second aperture, wherein the first aperture is disposed within the forefoot region and the midfoot region, and wherein the second aperture is disposed within the midfoot region and heel region.

* * * * *